US009410454B2

(12) United States Patent
Kobayashi et al.

(10) Patent No.: US 9,410,454 B2
(45) Date of Patent: Aug. 9, 2016

(54) VALVE OPENING/CLOSING TIMING CONTROL DEVICE

(71) Applicant: AISIN SEIKI KABUSHIKI KAISHA, Kariya-shi, Aichi (JP)

(72) Inventors: Masaki Kobayashi, Okazaki (JP); Yoshiaki Yamakawa, Toyota (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 0 days.

(21) Appl. No.: 14/772,450

(22) PCT Filed: Dec. 25, 2014

(86) PCT No.: PCT/JP2014/084218

§ 371 (c)(1),
(2) Date: Sep. 3, 2015

(87) PCT Pub. No.: WO2015/141096

PCT Pub. Date: Sep. 24, 2015

(65) Prior Publication Data

US 2016/0108769 A1 Apr. 21, 2016

(30) Foreign Application Priority Data

Mar. 19, 2014 (JP) ..... 2014-056929

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/3443* (2013.01); F01L 2001/34433 (2013.01); *F01L 2001/34463* (2013.01); *F01L 2001/34466* (2013.01); *F01L 2001/34473* (2013.01); *F01L 2001/34476* (2013.01); *F01L 2001/34479* (2013.01); *F01L 2001/34483* (2013.01); *F01L 2250/04* (2013.01); *F01L 2800/03* (2013.01)

(58) Field of Classification Search
CPC ..... F01L 1/344; F01L 1/3442; F01L 2250/04; F01L 2001/34483; F01L 2001/34476; F01L 2001/34433; F01L 2001/34479; F01L 2001/34473; F01L 2001/34466; F01L 2001/34463; F01L 2800/03; F01L 2001/3443
USPC ..... 123/90.17
See application file for complete search history.

(56) References Cited

U.S. PATENT DOCUMENTS

2010/0175651 A1 7/2010 Takenaka
2010/0313835 A1* 12/2010 Yamaguchi ..... F01L 1/3442 123/90.15
2012/0186547 A1 7/2012 Fujiyoshi et al.

FOREIGN PATENT DOCUMENTS

JP 2010-163942 A 7/2010
JP 2010-249031 A 11/2010

(Continued)

OTHER PUBLICATIONS

International Search Report (PCT/ISA/210) mailed on Mar. 24, 2015, by the Japanese Patent Office as the International Searching Authority for International Application No. PCT/JP2014/084218.

(Continued)

*Primary Examiner* — Zelalem Eshete
(74) *Attorney, Agent, or Firm* — Buchanan Ingersoll & Rooney PC

(57) ABSTRACT

A valve opening/closing timing control device includes an advancing chamber and a retarding chamber between driving and driven rotating bodies, an intermediate locking mechanism performing switching between a locked state and an unlocked state, an advancing channel connected to the advancing chamber, a retarding channel connected to the retarding chamber, and at least one electromagnetic valve supplying/discharging working fluid to/from the advancing chamber, retarding chamber, and intermediate lock mechanism due to an electricity supply amount being changed. When working fluid is discharged from the intermediate lock mechanism, and working fluid is supplied to the advancing chamber and is discharged from the retarding chamber, the maximum working fluid flow amount through the advancing and retarding channels is greater than the maximum working fluid flow amount through the advancing and retarding channels when the electromagnetic valve is controlled such that the working fluid is supplied to the intermediate lock mechanism.

3 Claims, 12 Drawing Sheets

(56) References Cited

FOREIGN PATENT DOCUMENTS

| | | | |
|---|---|---|---|
| JP | 2011-179385 | A | 9/2011 |
| JP | 2012-140968 | A | 7/2012 |
| JP | 2012-149597 | A | 8/2012 |

OTHER PUBLICATIONS

Written Opinion (PCT/ISA/237) mailed on Mar. 24, 2015, by the Japanese Patent Office as the International Searching Authority for International Application No. PCT/JP2014/084218.

* cited by examiner

| Electricity supply amount | 0 ← | | → | Maximum |
|---|---|---|---|---|
| Retarding channels | Drain | | Close | Supply |
| Advancing channels | Supply | | Close | Drain |
| Unlocking channels | Drain | Supply | | |
| Position of spool | W1 | W2 | W3 | W4 |

| Electricity supply amount | 0 ← | | | | → Maximum |
|---|---|---|---|---|---|
| Discharge channels | Drain | Close | | | Drain |
| Retarding channels | Drain | | Close | Supply | |
| Advancing channels | Supply | | Close | Drain | |
| Unlocking channels | Drain | Supply | | | Close |
| Position of spool | W1 | W2 | W3 | W4 | W5 |

VALVE OPENING/CLOSING TIMING CONTROL DEVICE

TECHNICAL FIELD

The present invention relates to a valve opening/closing timing control device that controls a relative rotation phase of a driven rotating body with respect to a driving rotating body that rotates synchronously with a crankshaft of an internal combustion engine.

BACKGROUND ART

In recent years, valve opening/closing timing control devices that make it possible to change the opening/closing timing of an intake valve and an exhaust valve in accordance with the operation status of an internal combustion engine (hereinafter referred to as an "engine" as well) have been put to practical use. These valve opening/closing timing control devices have a mechanism that, for example, by changing the relative rotation phase of the driven rotating body with respect to the rotation of the driving rotating body (hereinafter referred to as simply "relative rotation phase") by means of an engine operation, changes the opening/closing timing of an intake/exhaust valve that is opened and closed accompanying the rotation of the driven rotating body.

In general, the optimal opening/closing timing of the intake/exhaust valve differs according to the operation state of the engine, such as the state in which the engine is started, and the state in which the vehicle is traveling. By constraining the relative rotation phase to an intermediate lock phase between the maximum retard phase and the maximum advance phase when starting the engine, the opening/closing timing of the intake/exhaust valve that is optimal for starting the engine is realized, and a case in which a knocking sound is generated due to a partition of a fluid pressure chamber formed by the driving rotating body and the driven rotating body swinging is suppressed. For this reason, it is desired that the relative rotation phase is constrained to the intermediate lock phase before the engine is stopped. The stopping of the engine also includes idling stops in which the engine is stopped for a short amount of time at an intersection or the like so as to suppress the discharge of exhaust gas or the consumption of gasoline.

Patent Document 1 discloses a valve timing adjustment device that can reliably perform locking when a lock pin is to be locked in an intermediate phase between the maximum advance phase and the maximum retard phase. With this valve timing adjustment device, a control valve is configured to connect an advancing port and a lock port to a main supply port and a discharge opening respectively by moving to a first region, and to connect both the advancing port and the lock port to the main supply port by moving to a second region that is shifted away from the first region in a second direction. The first region is a lock region for locking the rotation phase in a restricted phase using a first main restricting member. Furthermore, the first region has a reduction region in which an advance supply flow amount to be supplied to an advancing chamber by connecting the advancing port in communication with the advancing chamber to the main supply port is reduced to a flow amount that is smaller than the flow amount at the moving end in the first direction. Accordingly, in the constricted region, the speed at which a vane rotor rotates to the advance side is a slower speed that corresponds to the flow amount controlled to be a smaller amount. Furthermore, when the phase of the vane rotor gradually changes to the advance side in this way, the lock port and the discharge opening are connected so that working oil is discharged from the lock chamber. Accordingly, locking of the rotation phase that accompanies the flow of the working oil from the lock chamber can be performed reliably due to the phase of the vane rotor gradually changing to the advance side.

PRIOR ART DOCUMENTS

Patent Documents

Patent Document 1: JP 2012-140968A

DISCLOSURE OF THE INVENTION

Problem to be Solved by the Invention

Recently, in vehicles having idling stop functions, in order to increase fuel efficiency, instructions for stopping the engine are given at an earlier timing. That is, a vehicle with an idling stop function is conventionally given an instruction to stop the engine after the vehicle speed reaches zero, whereas recently, instructions for stopping the engine have been given at a time of falling below a predetermined vehicle speed (e.g., 10 km/h). However, in order to suitably re-start the engine, the engine has to be stopped after the relative rotation phase has been constrained to an intermediate lock phase. For this reason, the relative rotation phase needs to be constrained to the intermediate lock phase in a short amount of time after the engine stop instruction has been given.

With the valve timing adjustment device disclosed in Patent Document 1, a configuration is used in which the speed at which the vane rotor rotates to the advance side is decreased in order to reliably lock the rotation phase in the intermediate lock phase. For this reason, in the case where the valve timing adjustment device is applied to a vehicle with an idling stop function, there is a risk that constraint to the intermediate lock phase will not be possible in a short amount of time.

Accordingly, there has been demand to provide a valve opening/closing timing control device that can change the relative rotation phase in a short amount of time so as to constrain it to the intermediate lock phase.

Means for Solving Problem

In order to solve the above-described problem, a characteristic configuration of a valve opening/closing timing control device according to the present invention lies in including: a driving rotating body that rotates synchronously with a driving shaft of an internal combustion engine; a driven rotating body that is arranged inside of the driving rotating body coaxially with an axis of the driving rotating body, and rotates integrally with a camshaft for opening/closing a valve of the internal combustion engine; a fluid pressure chamber defined between the driving rotating body and the driven rotating body; an advancing chamber and a retarding chamber formed by partitioning the fluid pressure chamber using a partition provided on at least one of the driving rotating body and the driven rotating body; an intermediate locking mechanism capable of, with supply/discharge of a working fluid, selectively switching between a locked state in which a relative rotation phase of the driven rotating body with respect to the driving rotating body is constrained to an intermediate lock phase between a maximum advance phase and a maximum retard phase, and an unlocked state in which the constraint to the intermediate lock phase is released; an advancing channel that allows passage of the working fluid to be supplied to or discharged from the advancing chamber; a retarding channel that allows passage of the working fluid to be supplied to or discharged from the retarding chamber; and at least one electromagnetic valve that changes a position of a spool by changing an electricity supply amount, and controls the supply and discharge of the working fluid to/from the advancing chamber, the retarding chamber, and the intermediate lock mechanism, wherein when in a lock transition mode in which the electromagnetic valve is controlled such that the working fluid is discharged from the intermediate lock mechanism, the working fluid is supplied to one of the advancing chamber and the retarding chamber, and the working fluid is discharged from the other one, maximum flow amounts of the working fluid that flows through the advancing channel and the retarding channel are greater than maximum flow amounts of the working fluid that flows through the advancing channel and the retarding channel when in a phase changeable mode in which the electromagnetic valve is controlled such that the working fluid is supplied to the intermediate lock mechanism.

If the flow amount of the working fluid that flows through the advancing channel is increased, the supply/discharge of the working fluid to/from the advancing chamber will be performed more rapidly, and if the flow amount of the working fluid that flows through the retarding channel is increased, the supply/discharge of the working fluid to/from the retarding chamber will be performed more rapidly. Also, if the supply/discharge of the working fluid to/from the advancing chamber or the retarding chamber is performed more rapidly, the speed at which the relative rotation phase changes in the advance direction or the retard direction will increase. Accordingly, if such a configuration is used, the speed at which the relative rotation phase changes in the advance direction or the retard direction will be greater in the lock transition mode in which the working fluid is discharged from the intermediate lock mechanism than in the phase changeable mode in which the working fluid is supplied to the intermediate lock mechanism. Accordingly, if the electromagnetic valve is controlled to be in the lock transition mode when the relative rotation phase is in the vicinity of the maximum retard phase or the maximum advance phase, for example, the relative rotation phase changes at a high speed, and it is possible to reach the state of being locked in the intermediate lock phase in a short amount of time.

With the valve opening/closing timing control device of the present invention, it is preferable that when in the lock transition mode, the flow amount of the working fluid that flows through the advancing channel and the retarding channel increases as the spool of the electromagnetic valve approaches an end of a range of motion of the spool.

When the spool is located at an end of its range of motion, the amount of electricity supplied to the solenoid that moves the spool is 0 or the maximum. In other words, when the amount of electricity supplied to the solenoid is 0 or the maximum, the supply/discharge of the working fluid to/from the advancing chamber or the retarding chamber is performed rapidly, and the speed at which the relative rotation phase changes in the advance direction or the retard direction reaches its maximum. Accordingly, if such a configuration is used, there is no need to finely control the electricity supply amount when it is desired that the relative rotation phase is changed at a high speed. In other words, by setting the electricity supply amount to 0 or the maximum, the relative rotation phase can be changed at a high speed, and the state of being locked in the intermediate lock phase can be reached in a short amount of time.

With the valve opening/closing timing control device of the present invention, it is preferable that in the lock transition mode, the relative rotation phase is configured to be changeable in both an advance direction and a retard direction, in the lock transition mode, the working fluid flows through a first discharge channel so as to be discharged from the intermediate lock mechanism while the relative rotation phase changes in the advance direction when the spool of the electromagnetic valve is at one end of the range of motion of the spool, and the working fluid flows through a second discharge channel so as to be discharged from the intermediate lock mechanism while the relative rotation phase changes in the retard direction when the spool is at the other end of the range of motion, if a retard change speed, which is a speed of the driven rotating body when the relative rotation phase changes in the retard direction, is greater than an advance change speed, which is a speed of the driven rotating body when the relative rotation phase changes in the advance direction, a flow amount of the working fluid that flows through the second discharge channel is greater than a flow amount of the working fluid that flows through the first discharge channel by at least a ratio of the retard change speed to the advance change speed, and if the advance change speed is greater than the retard change speed, the flow amount of the working fluid that flows through the first discharge channel is greater than the flow amount of the working fluid that flows through the second discharge channel by at least a ratio of the advance change speed to the retard change speed.

In order to realize the state of being locked in the intermediate lock phase in a short amount of time by changing the relative rotation phase at a high speed, it is necessary to discharge the working fluid from the intermediate lock mechanism in a short amount of time. In view of this, if such a configuration is used, the flow amount of the working fluid discharged from the intermediate lock mechanism when the relative rotation phase changes in the direction in which it changes at a higher speed can be made greater than the flow amount of the working fluid discharged from the intermediate lock mechanism when the relative rotation phase changes in the direction in which it changes at a lower speed. As a result, the state of being locked in the intermediate lock phase can be realized reliably also when the relative rotation phase is constrained at a high speed.

With the valve opening/closing timing control device of the present invention, it is preferable that in the phase changeable mode, the flow amount of the working fluid when the working fluid is supplied to the intermediate lock mechanism while the relative rotation phase is held is greater than the flow amount of the working fluid when the working fluid is supplied to the intermediate lock mechanism while the relative rotation phase is changed.

One significant problem that can occur when the intermediate lock mechanism is in the unlocked state is that of unintentionally entering the locked state. When the locked state is entered, change in the relative rotation phase is restricted, and therefore there is a risk that it will not be possible to change to a desired relative rotation phase. This kind of unintentional locked state occurs when oil pressure pulsation occurs in the working fluid accompanying variations in the torque of the camshaft that occur due to the rotation of the cams when the relative rotation phase is held in the intermediate lock phase, and the lower limit value of the oil pressure pulsation falls below the oil pressure at which the unlocked state can be maintained.

In view of this, if such a configuration is used, pressure loss caused by the working fluid acting on the intermediate lock mechanism when the relative rotation phase is held in the intermediate lock phase reaches its minimum. As a result, the lower limit value of the oil pressure pulsation can be increased, and the occurrence of an unintended locked state can be suppressed.

BEST MODE FOR CARRYING OUT THE INVENTION

1. First Embodiment

Hereinafter, a first embodiment in which the present invention is applied to a valve opening/closing timing control device for an intake valve in an automobile engine (hereinafter simply referred to as an "engine E") will be described in detail with reference to the drawings. In the following description of the embodiment, the engine E is an example of an internal combustion engine.

Overall Configuration

Figure 1:
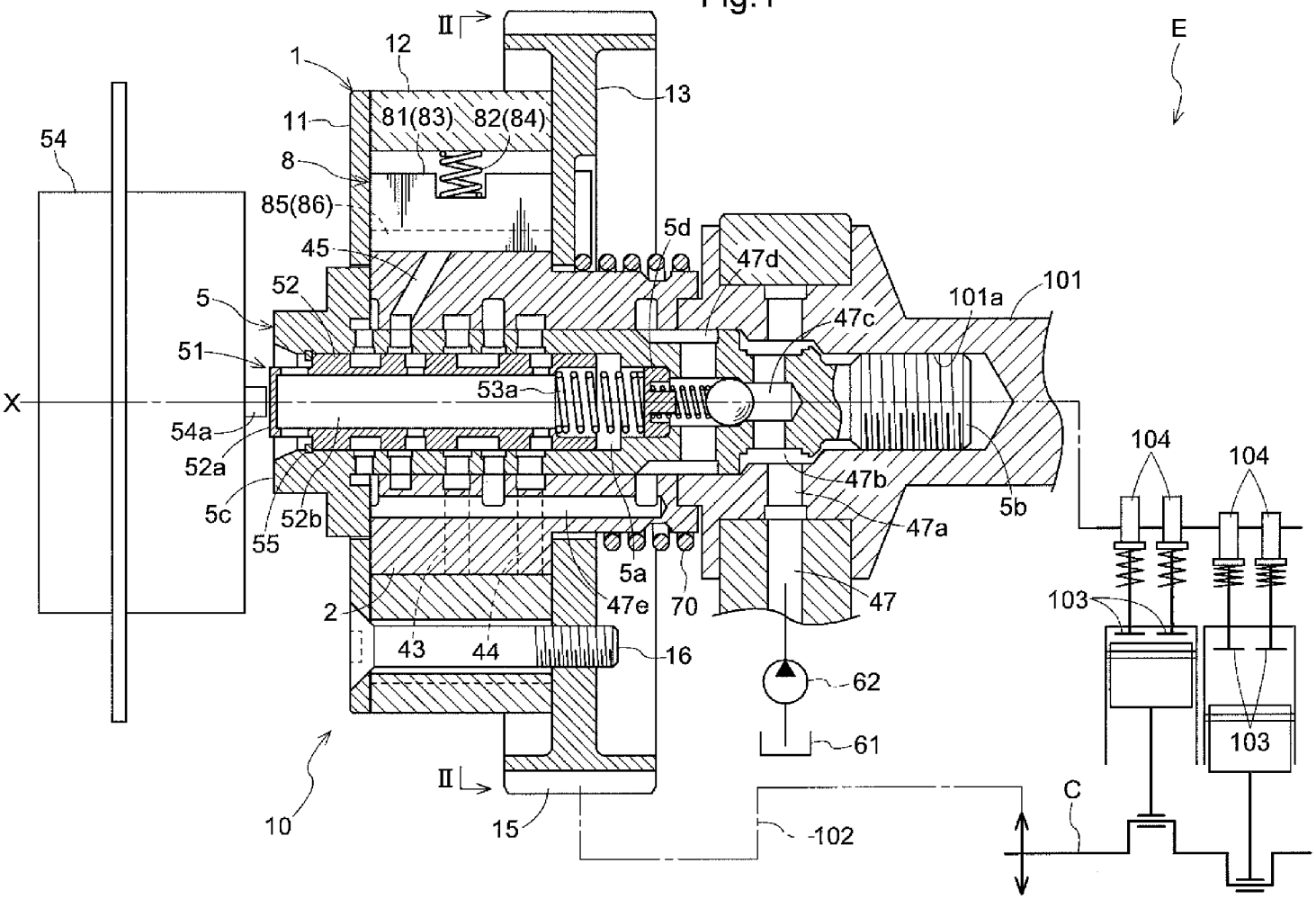
FIG. 1 is a vertical cross-sectional view showing a configuration of a valve opening/closing timing control device according to a first embodiment.

As shown in FIG. 1, a valve opening/closing timing control device 10 includes a housing 1 that rotates synchronously with a crankshaft C, and an inner rotor 2 that is disposed coaxially on axis X of the housing 1 inside of the housing 1 and rotates integrally with a camshaft 101 for opening/closing valves of the engine E. The camshaft 101 is a rotation shaft for cams 104, which control the opening/closing of intake valves 103 of the engine E, and rotates synchronously with the inner rotor 2 and a fixing bolt 5. The camshaft 101 is rotatably installed on a cylinder head of the engine E. Note that the crankshaft C is an example of a driving shaft, the housing 1 is an example of a driving rotating body, and the inner rotor 2 is an example of a driven rotating body.

A male screw 5*b* is formed on an end near the camshaft 101 of the fixing bolt 5. In a state in which the housing 1 and the inner rotor 2 are combined, the fixing bolt 5 is inserted into the middle and a male screw 5*b* of the fixing bolt 5 is screwed into a female screw 101*a* of the camshaft 101, and thereby the fixing bolt 5 is fixed to the camshaft 101 and the inner rotor 2 and the camshaft 101 are also fixed.

The housing 1 is constituted by installing, using a fastening bolt 16, a front plate 11 disposed on the side opposite to the side to which the camshaft 101 is connected, an outer rotor 12 fitted onto the inner rotor 2, and a rear plate 13 that integrally includes a timing sprocket 15 and is disposed on a side at which the camshaft 101 is connected. The inner rotor 2 is housed in the housing 1, and later-described fluid pressure chambers 4 are formed between the inner rotor 2 and the outer rotor 12. The inner rotor 2 and the outer rotor 12 are constituted so as to be able to rotate relative to each other about the axis X. Note that instead of the timing sprocket 15 being included in the rear plate 13, the timing sprocket 15 may be included in the outer circumferential portion of the outer rotor 12.

A return spring 70 that causes a biasing force to act in a direction of rotation centered about the axis X is included between the housing 1 and the camshaft 101. The return spring 70 has a function of causing a biasing force to act until the relative rotation phase of the inner rotor 2 with respect to the housing 1 (hereinafter simply referred to as the "relative rotation phase") reaches a predetermined relative rotation phase that is on the advance side from the maximum retard state (in the present embodiment, a later-described intermediate lock phase P), and not causing the biasing force to act in a range in which the relative rotation phase is on the advance side of the predetermined rotation phase. For example, a torsion spring or a spiral spring is used. Note that the return spring 70 may be disposed between the housing 1 and the inner rotor 2.

Figures 2, 3:
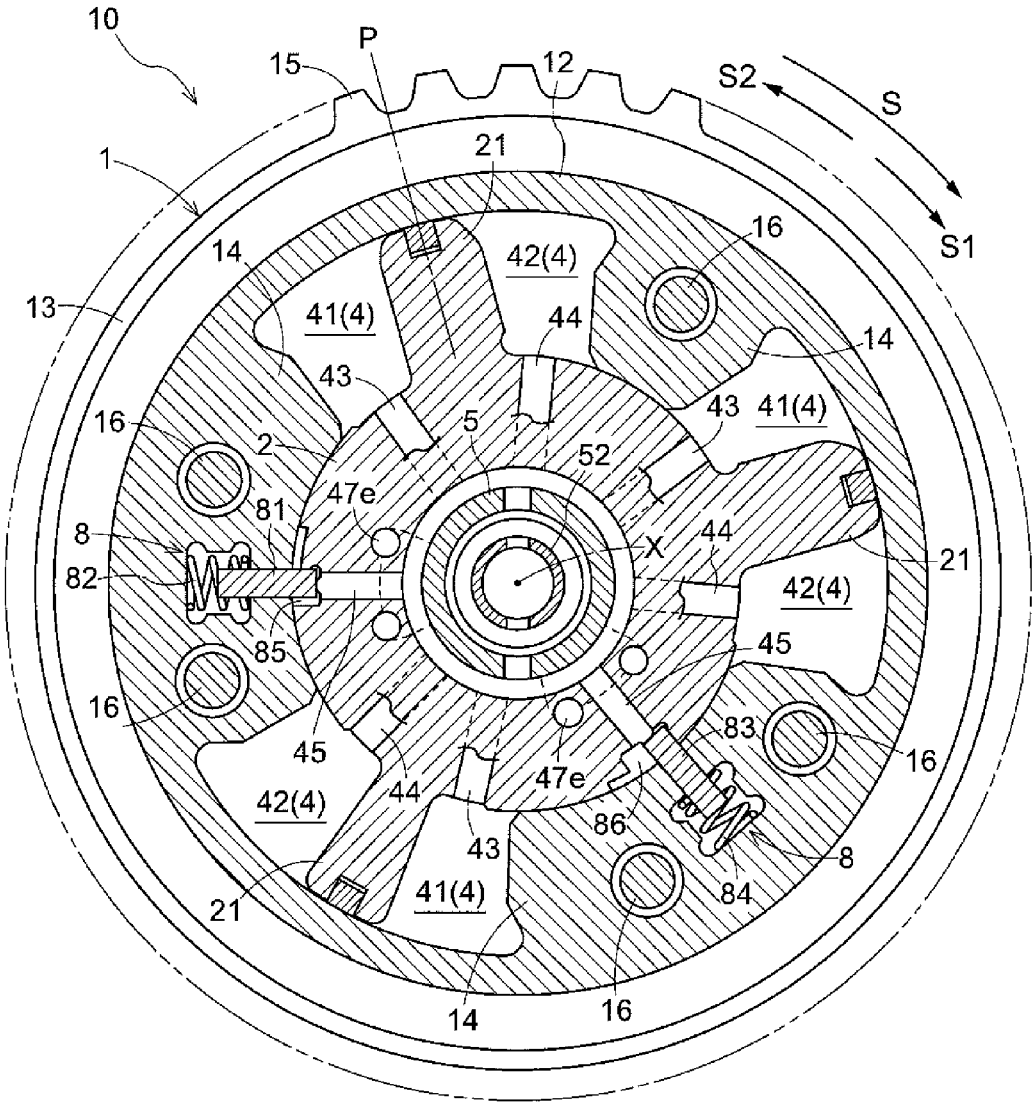
FIG. 2 is a cross-sectional view taken along line II-II in FIG. 1.
FIG. 3 is a diagram showing a state in which working oil flows through channels due to the action of an OCV.

When the crankshaft C is driven so as to rotate, the rotation driving force is transferred to the timing sprocket 15 via a power transfer member 102, and the housing 1 is driven so as to rotate in a rotation direction S shown in FIG. 2. Accompanying the rotation driving of the housing 1, the inner rotor 2 is driven so as to rotate in the rotation direction S so that the camshaft 101 rotates, and the cams 104 provided on the camshaft 101 press down the intake valves 103 of the engine E so as to open them.

As shown in FIG. 2, the fluid pressure chambers 4 are formed between the inner rotor 2 and the outer rotor 12 due to three protruding portions 14 that protrude inward in the radial direction and come into contact with the outer circumferential surface of the inner rotor 2 being formed apart from each other in the rotation direction S in the outer rotor 12. The protruding portions 14 also function as shoes on the outer circumferential surface of the inner rotor 2. Protruding portions 21 that come into contact with the inner circumferential surface of the outer rotor 12 are formed at portions on the outer circumferential surface of the inner rotor 2 which oppose the fluid pressure chambers 4. The fluid pressure chambers 4 are each divided into an advancing chamber 41 and a retarding chamber 42 by a protruding portion 21. Note that in the present embodiment, three fluid pressure chambers 4 are included, but there is no limitation to this.

Working oil (an example of working fluid) is supplied to or discharged from the advancing chambers 41 and the retarding chambers 42, or the supply/discharge thereof is blocked, and thereby the oil pressure of the working oil acts on the protruding portions 21, and the relative rotation phase is changed in the advance direction or the retard direction using the oil pressure, or is held at a certain phase. The advance direction is a direction in which the volume of the advancing chambers 41 increases, and is the direction indicated by arrow S1 in FIG. 2. The retard direction is a direction in which the volume of the retarding chambers 42 increases, and is the direction indicated by arrow S2 in FIG. 2. The relative rotation phase when the protruding portions 21 have reached their moving ends (ends of swinging centered about the axis X) in the advance direction S1 is referred to as the maximum advance phase, and the relative rotation phase when the protruding portions 21 have reached their moving ends (ends of swinging centered about the axis X) in the retard direction S2 is referred to as the maximum retard phase. Note that the maximum advance phase is a concept that includes not only the moving ends in the advance direction S1 of the protruding portions 21, but also the vicinities thereof. Similarly, the maximum retard phase is a concept that includes not only the moving ends in the retard direction S2 of the protruding portions 21, but also the vicinities thereof.

As shown in FIG. 2, advancing channels 43 that are in communication with the advancing chambers 41, retarding channels 44 that are in communication with the retarding chambers 42, and unlocking channels 45 through which working oil that is to be supplied to and discharged from a later-described intermediate lock mechanism 8 flows are formed in the inner rotor 2. As shown in FIG. 1, in the valve opening/closing timing control device 10, lubricating oil that is stored in an oil pan 61 of the engine E is used as the working oil, and the working oil is supplied to the advancing chambers 41, the retarding chambers 42, and the intermediate lock mechanism 8.

Intermediate Lock Mechanism

The valve opening/closing timing control device 10 includes an intermediate lock mechanism 8 that constrains the relative rotation phase to an intermediate lock phase P between the maximum advance phase and the maximum retard phase by constraining change in the relative rotation phase of the inner rotor 2 with respect to the housing 1. Due to the engine E being started in a state where the relative rotation phase is constrained to the intermediate lock phase P, even in a situation where the oil pressure of the working oil immediately after the engine start operation is not stable, the rotation phase of the camshaft 101 with respect to the rotation phase of the crankshaft C is maintained appropriately, and stable rotation of the engine E can be realized.

As shown in FIG. 2, the intermediate lock mechanism 8 is constituted by a first lock member 81, a first spring 82, a second lock member 83, a second spring 84, a first recessed portion 85, and a second recessed portion 86.

The first lock member 81 and the second lock member 83 are constituted by plate-shaped members, and are movably supported on the outer rotor 12 such that they can be brought toward and separated from the inner rotor 2 in an orientation parallel to the axis X. The first lock member 81 moves toward the inner rotor 2 due to the biasing force of the first spring 82, and the second lock member 83 moves toward the inner rotor 2 due to the biasing force of the second spring 84.

The first recessed portion 85 is defined in a groove shape along the direction of the axis X in the outer circumference of the inner rotor 2. The first recessed portion 85 is such that a shallow groove and a deep groove are formed continuously in the circumferential direction toward the retard direction S2. The groove width of the shallow groove is larger than the thickness of the first lock member 81, and the groove width of the deep groove is equivalent to that of the shallow groove and is larger than the thickness of the first lock member 81. The second recessed portion 86 is defined in a groove shape along the direction of the axis X in the outer circumference of the inner rotor 2. The second recessed portion 86 is such that a shallow groove and a deep groove are formed continuously in the circumferential direction toward the retard direction S2. The groove width of the shallow groove is about the same as the thickness of the second lock member 83, and the groove width of the deep groove is sufficiently larger than the thickness of the second lock member 83 and is larger than the groove width of the deep groove of the first recessed portion 85.

As shown in FIG. 2, with the intermediate lock phase P in a state in which no working oil has been supplied to the first recessed portion 85 and the second recessed portion 86, after moving toward the inner rotor 2 due to the biasing force of the first spring 82, the first lock member 81 fits into the first recessed portion 85, and the first lock member 81 comes into contact with the end in the advance direction S1 of the deep groove of the first recessed portion 85 so as to restrict the inner rotor 2 from changing in the retard direction S2. Also, after moving toward the inner rotor 2 due to the biasing force of the second spring 84, the second lock member 83 fits into the second recessed portion 86 and the second lock member 83 comes into contact with the end in the retard direction S2 of the deep groove of the second recessed portion 86 so as to restrict the inner rotor 2 from changing in the advance direction S1. Thus, the relative rotation phase is constrained to the intermediate lock phase P by simultaneously restricting change in the advance direction S1 and the retard direction S2 of the inner rotor 2. This is the locked state.

The unlocking channels 45 are connected to the bottom surfaces of the deep groove of the first recessed portion 85 and the deep groove of the second recessed portion 86, and when the working oil flows through the unlocking channels 45 so as to be supplied to the first recessed portion 85 and the second recessed portion 86 when in the locked state, the first lock member 81 and the second lock member 83 receive the oil pressure of the working oil. If the oil pressure exceeds the biasing force of the first spring 82 and the second spring 84, the first lock member 81 and the second lock member 83 separate from the first recessed portion 85 and the second recessed portion 86 respectively, and the unlocked state is entered. Also, the working oil, which is in the first recessed portion 85 and the second recessed portion 86 in the unlocked state, flows through the unlocking channels 45 and can be discharged to the outside of the valve opening/closing timing control device 10. Thus, the unlocking channels 45 allow passage of working fluid that is to be supplied to or discharged from the first recessed portion 85 and the second recessed portion 86.

OCV

As shown in FIG. 1, in the present embodiment, an OCV (oil control valve) 51 is disposed inside of the inner rotor 2, coaxially with the axis X. The OCV 51 is an example of an electromagnetic valve. The OCV 51 is configured to include a spool 52, a first valve spring 53*a* that biases the spool 52, and an electromagnetic solenoid 54 that drives the spool 52 due to the electricity supply amount being changed. Note that the electromagnetic solenoid 54 is a known technology and therefore will not be described in detail here.

The spool 52 is accommodated in an accommodation space 5*a*, which is a hole with a circular cross-section that is formed in the direction of the axis X starting from a head portion 5*c*, which is the end that is further from the camshaft 101 of the fixing bolt 5, and the spool 52 can slide in the direction of the axis X inside of the accommodation space 5*a*. The spool 52 also has a main discharge channel 52*b*, which is a bottomed hole with a circular cross-section along the direction of the axis X. The inner diameter of the main discharge channel 52*b* is larger near the entrance than in the interior, and a level difference is formed therein.

The first valve spring 53*a* is provided deep inside of the accommodation space 5*a*, and normally biases the spool 52 in the direction of the electromagnetic solenoid 54 (the leftward direction in FIG. 1). The spool 52 is prevented from popping out of the accommodation space 5*a* by a stopper 55 attached to the accommodation space 5*a*. The level difference formed in the main discharge channel 52*b* holds one end of the first valve spring 53*a*. A partition 5*d* is inserted at the border between the accommodation space 5*a* and a third supply portion 47*c*, which is a bottomed hole with a smaller inner diameter and is formed continuously with the accommodation space 5*a*. The partition 5*d* holds the other end of the first valve spring 53*a*. When electricity is supplied to the electromagnetic solenoid 54, a push pin 54*a* provided in the electromagnetic solenoid 54 presses the end 52*a* of the spool 52. As a result, the spool 52 slides in the direction of the camshaft 101 against the biasing force of the first valve spring 53*a*. The OCV 51 is configured to be able to adjust the position of the spool 52 by changing the amount of electricity supplied to the electromagnetic solenoid 54 from 0 to the maximum. The amount of electricity supplied to the electromagnetic solenoid 54 is controlled by an ECU (electronic control unit) (not shown).

According to the position of the spool 52, the OCV 51 switches between the supply of working oil to the advancing chambers 41 and the retarding chambers 42, discharge thereof, and holding thereof, and performs switching between the supply of working oil to the intermediate lock mechanism 8 and the discharge thereof. FIG. 3 shows an active configuration of the OCV 51 when the position of the spool 52 is changed to W1 to W5 according to the amount of electricity supplied to the electromagnetic solenoid 54.

Oil Channel Configuration

As shown in FIG. 1, the working oil stored in the oil pan 61 is pumped by a mechanical oil pump 62 that is driven by the rotation driving force of the crankshaft C being transferred thereto, and the working oil flows through a later-described supply channel 47. Then, after flowing through the supply channel 47, the working oil is supplied to the advancing channels 43, the retarding channels 44, and the unlocking channels 45 via the OCV 51.

As shown in FIG. 1 and FIGS. 5 to 9, the advancing channels 43, which are connected to the advancing chambers 41, are each constituted by a first advancing portion 43*a*, which is a through hole formed in the fixing bolt 5 and a second advancing portion 43*b* that is connected to the first advancing portion 43*a* and is formed in the inner rotor 2. The retarding channels 44, which are connected to the retarding chambers 42, are each constituted by a first retarding portion 44*a*, which is a through hole formed in the fixing bolt 5, and a second retarding portion 44*b* that is connected to the first retarding portion 44*a* and is formed in the inner rotor 2. The unlocking channels 45, which are connected to the first recessed portion 85 and the second recessed portion 86, are each constituted by a first unlocking portion 45*a*, which is a through hole formed in the fixing bolt 5, and a second unlocking portion 45*b* that is connected to the first unlocking portion 45*a* and is formed in the inner rotor 2.

A supply channel 47 is constituted by a first supply portion 47*a* formed in the camshaft 101, a second supply portion 47*b*, which is a space between the camshaft 101 and the fixing bolt 5, a third supply portion 47*c* formed in the fixing bolt 5, a fourth supply portion 47*d* formed around the fixing bolt 5, a fifth supply portion 47*e* formed in the inner rotor 2, and two sixth supply portions 47*f* formed at different locations in the direction of the axis X of the fixing bolt 5, and the channels are connected in the stated order.

The third supply portion 47*c* is constituted by a bottomed hole formed in the fixing bolt 5 in the direction of the axis X, and multiple holes penetrating to the outside at two different locations in the axis X direction in the bottomed hole. A check valve 48 is included in the bottomed hole, and the check valve 48 is biased in the direction of closing the bottomed hole of the third supply portion 47*c* by a second valve spring 53*b*, which is held by the partition 5*d* and the check valve 48.

The fifth supply portion 47*e* is constituted by a channel that is formed in the fixing bolt 5 in the direction of the axis X and whose ends are closed, and three ring-shaped grooves formed inwardly in the diameter direction from the channel to the inner circumferential surface at three different locations in the axis X direction. One of the three ring-shaped grooves opposes the fourth supply portion 47*d* and the remaining two ring-shaped grooves respectively oppose separate sixth supply portions 47*f*.

Figure 5:
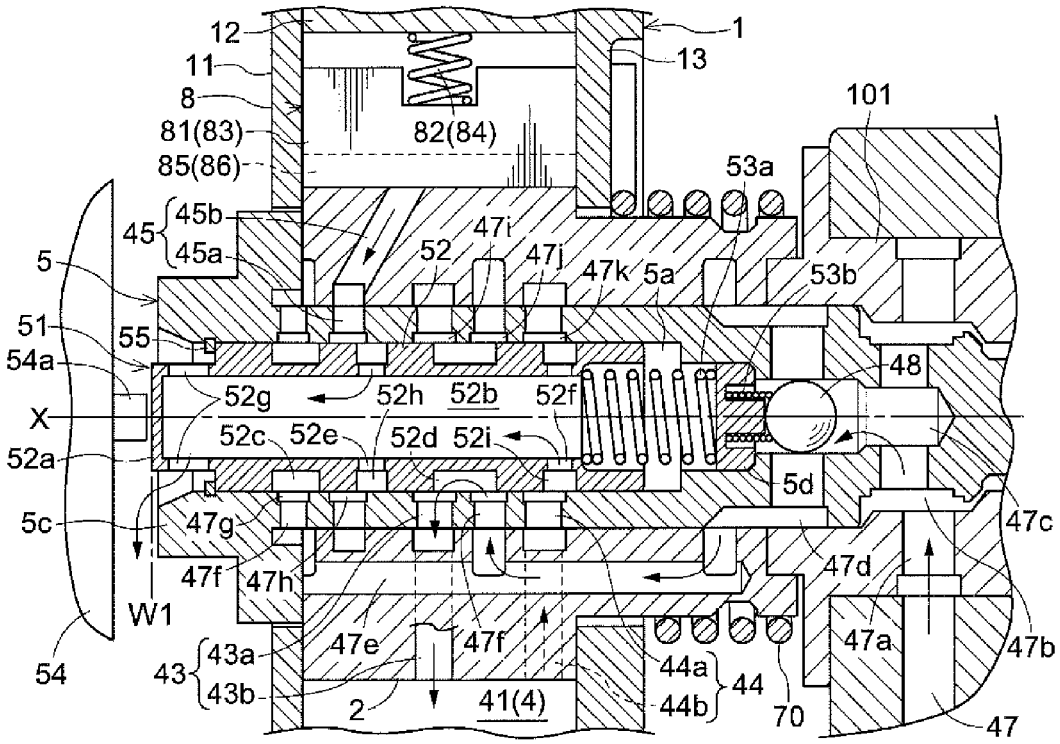
FIG. 5 is an enlarged cross-sectional view showing an active state of the OCV in W1.

As shown in order starting from the left in FIG. 5, a sixth supply portion 47*f*, the first unlocking portion 45*a*, the first advancing portion 43*a*, a sixth supply portion 47*f*, and the first retarding portion 44*a*, which are through holes formed in the fixing bolt 5, are respectively connected to the first ring-shaped groove 47*g*, the second ring-shaped groove 47*h*, the third ring-shaped groove 47*i*, the fourth ring-shaped groove 47*j*, and the fifth ring-shaped groove 47*k*, which are ring-shaped grooves formed in the inner circumferential surface opposing the accommodation space 5*a* of the fixing bolt 5.

A seventh ring-shaped groove 52*c* and an eighth ring-shaped groove 52*d* that supply the working oil that flows through the supply channel 47 to one of the advancing channels 43, the retarding channels 44, and the unlocking channels 45 are formed in the outer circumferential surface of the spool 52. Furthermore, a first through hole 52*e* and a second through hole 52*f* for discharging the working oil that flows through the advancing channels 43, the retarding channels 44, and the unlocking channels 45 to the main discharge channel 52*b* are formed in the spool 52. The first through hole 52*e* and the second through hole 52*f* are respectively connected to a ninth ring-shaped groove 52*h* and a tenth ring-shaped groove 52*i*, which are ring-shaped grooves formed in the outer circumferential surface of the spool 52. Furthermore, third through holes 52*g* that discharge the working oil that flows through the main discharge channel 52*b* to the outside of the valve opening/closing timing control device 10 are formed.

Operation of OCV (1) W1 State

As shown in FIG. 5, if electricity is not supplied to the electromagnetic solenoid 54 (electricity supply amount is 0), the OCV 51 is in the W1 state shown in FIG. 3, and the spool 52 comes into contact with the stopper 55 and is located leftmost due to the biasing force of the first valve spring 53*a*. If the working oil is supplied to the supply channel 47 in this state, the working oil will flow through the first supply portion 47*a*, the second supply portion 47*b*, and the third supply portion 47*c*. If the oil pressure acting on the check valve 48 exceeds the biasing force of the second valve spring 53*b* in the third supply portion 47*c*, the check valve 48 opens. Then, the working oil passes through the fourth supply portion 47*d*, the fifth supply portion 47*e*, and the sixth supply portion 47*f* so as to reach the seventh ring-shaped groove 52*c* via the first ring-shaped groove 47*g* and to reach the eighth ring-shaped groove 52*d* via the fourth ring-shaped groove 47*j*.

The seventh ring-shaped groove 52*c* is not connected to any of the channels, and thus no more working oil flows thereto. The eighth ring-shaped groove 52*d* is connected to the advancing channels 43 via the third ring-shaped groove 47*i*, and therefore the working oil flows through the advancing channels 43 so as to be supplied to the advancing chambers 41. In other words, the advancing channels 43 are in the supply state. On the other hand, the retarding channels 44 are connected to the second through hole 52*f* via the fifth ring-shaped groove 47*k* and the tenth ring-shaped groove 52*i*, and the unlocking channels 45 are connected to the first through hole 52*e* via the second ring-shaped groove 47*h* and the ninth ring-shaped groove 52*h*. For this reason, the working oil in the retarding chambers 42, the first recessed portion 85, and the second recessed portion 86 is discharged from the main discharge channel 52*b* to the outside of the valve opening/closing timing control device 10 through the third through holes 52*g*. In other words, the retarding channels 44 and the unlocking channels 45 are all in the drain state. Accordingly, as shown in FIG. 3, the W1 state is a state in which working oil is discharged from the intermediate lock mechanism 8 (first recessed portion 85, second recessed portion 86) and the retarding chambers 42 and the working oil is supplied to the advancing chambers 41 so that the relative rotation phase changes in the advance direction S1, and this corresponds to "locking in the intermediate lock phase P by means of an advancing action". The W1 state corresponds to a lock transition mode in the present invention.

If the oil pressure of the working oil is constant in the W1 state, the flow amount of the working oil that flows through the advancing channels 43 to be supplied to the advancing chambers 41 is determined by the smaller of an area of opposition between the third ring-shaped groove 47*i* and the eighth ring-shaped groove 52*d* (hereinafter referred to as "first area") and an area of opposition between the fourth ring-shaped groove 47*j* and the eighth ring-shaped groove 52*d* (hereinafter referred to as "second area"). In the state shown in FIG. 5, the first area and the second area are approximately the same, and therefore the flow amount is not determined by either of them. The flow amount of the working oil that is discharged from the retarding chambers 42 and flows through the retarding channels 44 is determined by the area of the fifth ring-shaped groove 47*k* and the tenth ring-shaped groove 52*i* (hereinafter referred to as "third area"). The flow amount of the working oil that is discharged from the first recessed portion 85 and the second recessed portion 86 and flows through the unlocking channels 45 is determined by the area of the second ring-shaped groove 47*h* and the ninth ring-shaped groove 52*h* (hereinafter referred to as "fourth area"). Hereinafter, description will be given under the assumption that the oil pressure of the working oil is constant, although this is not specifically stated. Accordingly, the flow amount of the working oil is determined by the size of the areas of opposition between the ring-shaped grooves.

Figure 4:
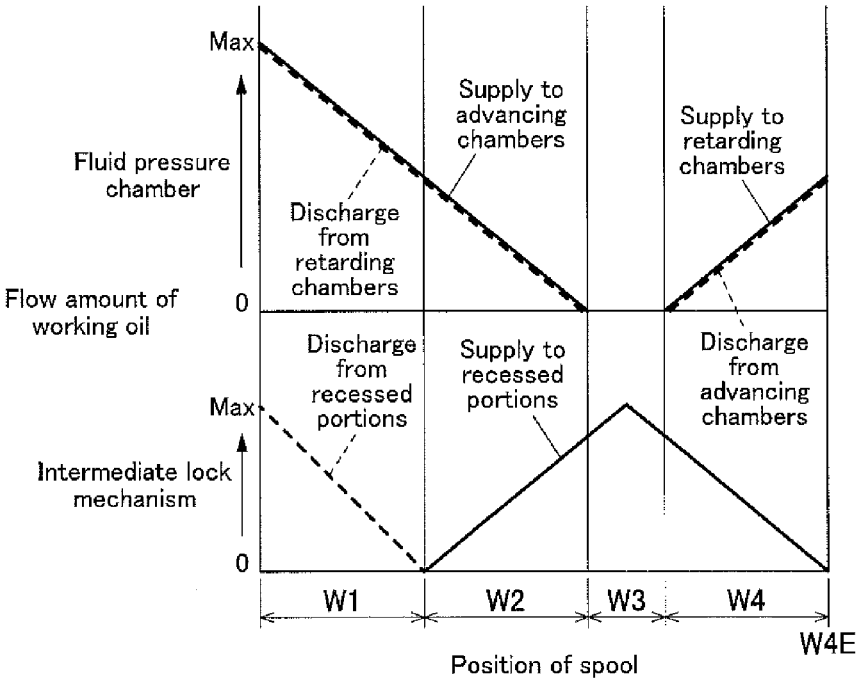
FIG. 4 is a graph showing change in the flow amounts of the working oil supplied to and discharged from an advancing chamber, a retarding chamber, and an intermediate lock mechanism when the position of a spool is changed.

If the amount of electricity supplied to the electromagnetic solenoid 54 is increased while the W1 state shown in FIG. 3 is maintained, the spool 52 moves rightward from the state shown in FIG. 5. Accompanying the movement, the first area decreases monotonically and the second area increases monotonically. Accordingly, the flow amount is determined by the first area, and as shown in FIG. 4, the flow amount of the working oil that flows through the advancing channels 43 and is supplied to the advancing chambers 41 (solid line in the upper graph) decreases monotonically. The third area and the fourth area also decrease monotonically, and the flow amount of the working oil that is discharged from the retarding chambers 42 and flows through the retarding channels 44 (broken line in the upper graph) and the flow amount of the working oil that is discharged from the first recessed portion 85 and the second recessed portion 86 and flows through the unlocking channels 45 (broken line in the lower graph) also decreases monotonically. That is to say, when the amount of electricity supplied to the electromagnetic solenoid 54 is increased, the speed at which the relative rotation phase changes in the advance direction S1 decreases. Paradoxically, the flow amounts of the working oil that flows through the advancing channels 43, the retarding channels 44, and the unlocking channels 45 in the lock transition mode (W1) increase monotonically as the position of the spool 52 approaches the left end due to the amount of electricity supplied to the electromagnetic solenoid 54 approaching 0, and are at their maximums when the electricity supply amount is 0.

If the flow amount of working oil that flows through the advancing channels 43 increases, the supply of working oil to the advancing chambers 41 is performed more rapidly, and if the flow amount of working oil that flows through the retarding channels 44 increases, the discharge of working oil from the retarding chambers 42 is performed more rapidly. If the supply and discharge of working oil to/from the advancing chambers 41 and the retarding chambers 42 is performed more rapidly, the speed at which the relative rotation phase changes in the advance direction S1 increases. Also, if the flow amount of working oil that flows through the unlocking channels 45 is increased, the discharge of working oil in the first recessed portion 85 and the second recessed portion 86 is performed more rapidly. As a result, when the amount of electricity supplied to the electromagnetic solenoid 54 is 0, the speed at which the relative rotation phase changes in the advance direction S1 reaches its maximum, and the working oil in the first recessed portion 85 and the second recessed portion 86 is discharged at the maximum speed. Accordingly, if the amount of electricity supplied to the electromagnetic solenoid 54 is set to 0 when the relative rotation phase is in the vicinity of the maximum retard phase, the state of being locked in the intermediate lock phase P can be realized in a short amount of time by changing the relative rotation phase in the advance direction S1 at a high speed.

(2) W2 State

Figure 6:
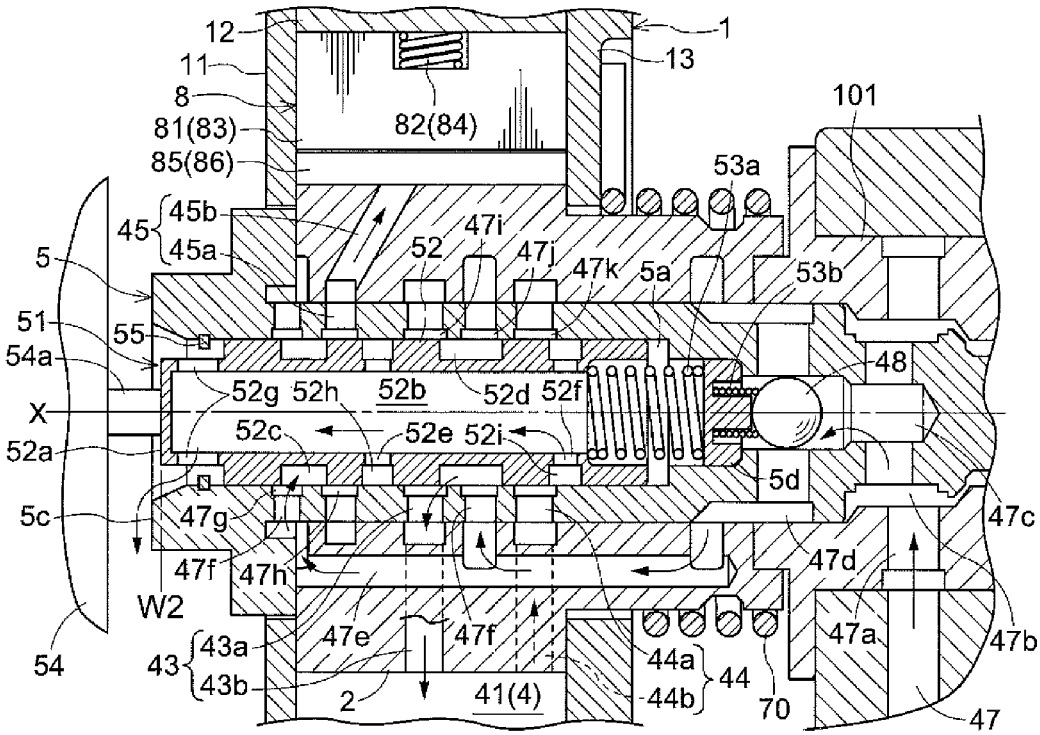
FIG. 6 is an enlarged cross-sectional view showing an active state of the OCV in W2.

As shown in FIG. 6, if the amount of electricity supplied to the electromagnetic solenoid 54 is increased so that the OCV 51 enters the W2 state shown in FIG. 3, the spool 52 moves slightly rightward from the W1 state. If the working oil is supplied to the supply channel 47 in this state, the working oil will reach the seventh ring-shaped groove 52*c* and the eighth ring-shaped groove 52*d*. The seventh ring-shaped groove 52*c* is connected to the unlocking channels 45 via the second ring-shaped groove 47*h*, and therefore the working oil flows through the unlocking channels 45 so as to be supplied to the first recessed portion 85 and the second recessed portion 86. In other words, the unlocking channels 45 are switched to the supply state. Accordingly, if the oil pressure of the supplied working oil exceeds the biasing force of the first spring 82 and the second spring 84, the first lock member 81 and the second lock member 83 separate from the first recessed portion 85 and the second recessed portion 86 respectively, and the unlocked state is entered. Note that FIG. 6 shows a state directly after a switch from the W1 state to the W2 state is performed.

The eighth ring-shaped groove 52*d* is still connected to the advancing channels 43, and therefore the working oil flows through the advancing channels 43 and is supplied to the advancing chambers 41. In other words, the advancing channels 43 are in the supply state. On the other hand, since the retarding channels 44 are still connected to the second through hole 52*f*, the working oil in the retarding chambers 42 is discharged from the main discharge channel 52*b* to the outside of the valve opening/closing timing control device 10 through the third through holes 52*g*. In other words, the retarding channels 44 are in the drain state. Accordingly, as shown in FIG. 3, the W2 state is a state in which working oil is supplied to the intermediate lock mechanism 8 (first recessed portion 85, second recessed portion 86) and the advancing chambers 41 and the working oil is discharged from the retarding chambers 42 so that the relative rotation phase changes in the advance direction S1, and this corresponds to "an advancing action in an unlocked state". The W2 state corresponds to a phase changeable mode in the present invention.

In the W2 state, the flow amount of the working oil that flows through the advancing channels 43 and is supplied to the advancing chambers 41 is determined by the first area, and the flow amount of the working oil that is discharged from the retarding chambers 42 and flows through the retarding channels 44 is determined by the third area. This is the same as the W1 state, but both the first area and the third area are even smaller than the smallest area in the W1 state. On the other hand, the flow amount of the working oil that flows through the unlocking channels 45 and is supplied to the first recessed portion 85 and the second recessed portion 86 is determined by the smaller of the area of opposition between the first ring-shaped groove 47*g* and the seventh ring-shaped groove 52*c* (hereinafter referred to as "fifth area") and the area of opposition between the second ring-shaped groove 47*h* and the seventh ring-shaped groove 52*c* (hereinafter referred to as "sixth area"). In the state shown in FIG. 6, the sixth area is smaller than the fifth area, and therefore the flow amount is determined by the sixth area.

If electricity is further supplied to the electromagnetic solenoid 54 while the W2 state shown in FIG. 3 is maintained, the spool 52 moves rightward from the state shown in FIG. 6. Accompanying the movement, the first area decreases monotonically. Accordingly, as shown in FIG. 4, the flow amount of the working oil that flows through the advancing channels 43 and is supplied to the advancing chambers 41 (the solid line in the upper graph) further decreases in comparison to the W1 state. The third area also decreases monotonically and the flow amount of the working oil that is discharged from the retarding chambers 42 and flows through the retarding channels 44 (the broken line in the upper graph) also further decreases in comparison to the W1 state. That is to say, when the amount of electricity supplied to the electromagnetic solenoid 54 is increased, the speed at which the relative rotation phase changes in the advance direction S1 decreases further.

Although the fifth area decreases monotonically and the sixth area increases monotonically, the sixth area is still smaller, and therefore the flow amount of the working oil that flows through the unlocking channels 45 and is supplied to the first recessed portion 85 and the second recessed portion 86 (the solid line in the lower graph) is determined by the sixth area, and the flow amount increases. According to the above description, when the amount of electricity supplied to the electromagnetic solenoid 54 is the minimum for maintaining the W2 state, the flow amounts of the working oil that flows through the advancing channels 43 and the retarding channels 44 reach their maximum, and the flow amount of the working oil that flows through the unlocking channels 45 reaches its minimum.

As a result, as shown in FIG. 4, from the W1 state to the W2 state, the flow amount of the working oil that flows through the advancing channels 43 and is supplied to the advancing chambers 41, and the flow amount of the working oil that is discharged from the retarding chambers 42 and flows through the retarding channels 44 both decrease monotonically, and the relative rotation phase changes in the advance direction S1. Also, the maximum flow amounts of the working oil that flows through the advancing channels 43 and is supplied to the advancing chambers 41 and the working oil that is discharged from the retarding chambers 42 and flows through the retarding channels 44 when in the lock transition mode (W1) are greater than the maximum flow amounts of the working oil that flows through the advancing channels 43 and is supplied to the advancing chambers 41 and the working oil that is discharged from the retarding chambers 42 and flows through the retarding channels 44 when in the phase changeable mode (W2). On the other hand, the working oil that flows through the unlocking channels 45 to be supplied to or discharged from the intermediate lock mechanism 8 is discharged as the flow amount decreases monotonically in the W1 state, and temporarily reaches 0 when switching from W1 to W2 is performed. Thereafter, upon switching to W2, switching from discharging to supplying is performed, and while in the W2 state, the flow amount of the working oil supplied to the intermediate lock mechanism 8 increases monotonically.

(3) W3 State

Figure 7:
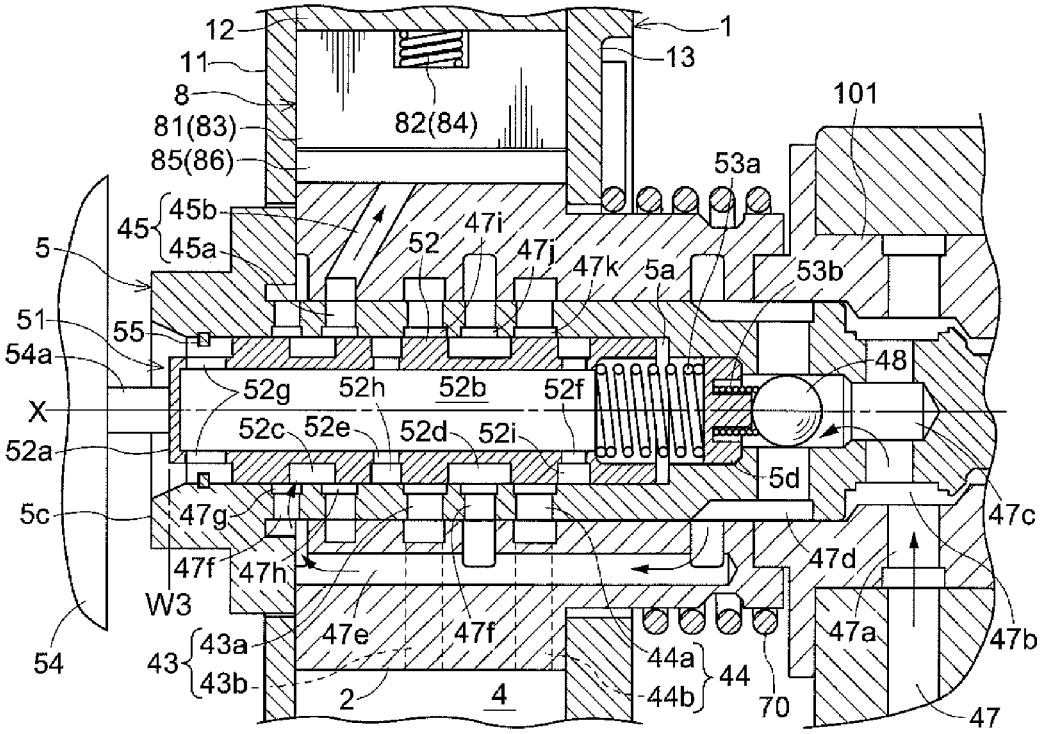
FIG. 7 is an enlarged cross-sectional view showing an active state of the OCV in W3.

As shown in FIG. 7, if electricity is further supplied to the electromagnetic solenoid 54 so that the OCV 51 enters the W3 state shown in FIG. 3, the spool 52 moves slightly rightward from the W2 state. If the working oil is supplied to the supply channel 47 in this state, the working oil will reach the seventh ring-shaped groove 52*c* and the eighth ring-shaped groove 52*d*. Since the seventh ring-shaped groove 52*c* is still connected to the unlocking channels 45, the working oil flows through the unlocking channels 45 and is supplied to the first recessed portion 85 and the second recessed portion 86. In other words, the unlocking channels 45 are in the supply state. Accordingly, in the W3 state as well, the unlocking state is maintained continuously from when in the W2 state. Note that FIG. 7 shows a state near the center in the W3 state shown in FIG. 3.

The eighth ring-shaped groove 52*d* is not connected to any of the channels, and thus no more working oil flows thereto. In other words, the working oil is not supplied to the advancing channels 43 or the retarding channels 44. Also, the advancing channels 43 and the retarding channels 44 are not connected to the first through hole 52*e* or the second through hole 52*f*, and therefore a case does not occur in which the working oil in the advancing chambers 41 or the retarding chambers 42 is discharged to the outside of the valve opening/closing timing control device 10. Accordingly, since supply and discharge of the working oil to/from the advancing chambers 41 and the retarding chambers 42 is not performed when the OCV 51 is controlled so as to be in the W3 state, the inner rotor 2 is held at the relative rotation phase at that time and does not change in the advance direction S1 or the retard direction S2. Accordingly, as shown in FIG. 3, the W3 state is a state in which the working oil is supplied to the intermediate lock mechanism 8 (first recessed portion 85, second recessed portion 86), the working oil is not supplied to or discharged from the advancing chambers 41 or the retarding chambers 42, and the relative rotation phase is held. This corresponds to "intermediate phase holding". The W3 state also corresponds to a phase changeable mode in the present invention.

In the W3 state, the flow amount of the working oil that flows through the unlocking channels 45 and is supplied to the first recessed portion 85 and the second recessed portion 86 is determined based on the magnitude relationship between the fifth area and the sixth area, but in FIG. 7, the fifth area and the sixth area are the same size. Accordingly, it is not determined by either of the areas. Also, if the electricity supply amount changes from this state so as to increase or decrease, a magnitude relationship will appear between the fifth area and the sixth area, and the flow amount will be determined by the smaller area. Accordingly, as indicated by the solid line in the lower graph in FIG. 4, when the spool 52 is at the position shown in FIG. 7 (the center of the W3 state), the flow amount of the working oil that flows through the unlocking channels 45 and is supplied to the first recessed portion 85 and the second recessed portion 86 reaches its maximum, and the flow amount of the working oil decreases monotonically as the spool 52 moves left or right thereafter.

One significant problem that can occur when the intermediate lock mechanism 8 is in the unlocked state is that of entering the locked state due to at least one of the first lock member 81 and the second lock member 83 unintentionally being fit into the first recessed portion 85 and the second recessed portion 86. When the locked state is entered, change in the relative rotation phase is restricted, and therefore there is a risk that it will not be possible to change to a desired relative rotation phase. In the state of being held at a relative rotation phase in which at least one of the first lock member 81 and the second lock member 83 is above the first recessed portion 85 or the second recessed portion 86, an oil pressure pulsation is generated in the working oil accompanying variations in the torque of the camshaft 101 that occur due to the rotation of the cams 104. An unintended locked state occurs when the lower limit value of the oil pressure pulsation falls below the oil pressure at which the unlocked state can be maintained.

In the present embodiment, as shown in FIG. 4, when in the W3 state, there is a position of the spool 52 at which the area (fifth area or sixth area) by which the passage of the working oil is determined reaches its maximum. Pressure loss accompanying passage of the working oil decreases as the area increases, and therefore if the area is at its maximum, the pressure loss in the working oil that flows through the unlocking channels 45 and is supplied to the first recessed portion 85 and the second recessed portion 86 is at its minimum. As a result, the lower limit value of the oil pressure pulsation can be increased, and the occurrence of an unintended locked state can be suppressed.

Also, regardless of which direction the spool 52 moves in from the position of the spool 52 at which the area reaches its maximum, the flow amount of the working oil that flows through the unlocking channels 45 and is supplied to the first recessed portion 85 and the second recessed portion 86 will decrease monotonically, and the flow amount for when switching between W2 and W1 is performed will be 0. Accordingly, it is possible to switch to the lock transition mode quickly and reliably.

(4) W4 State

Figure 8:
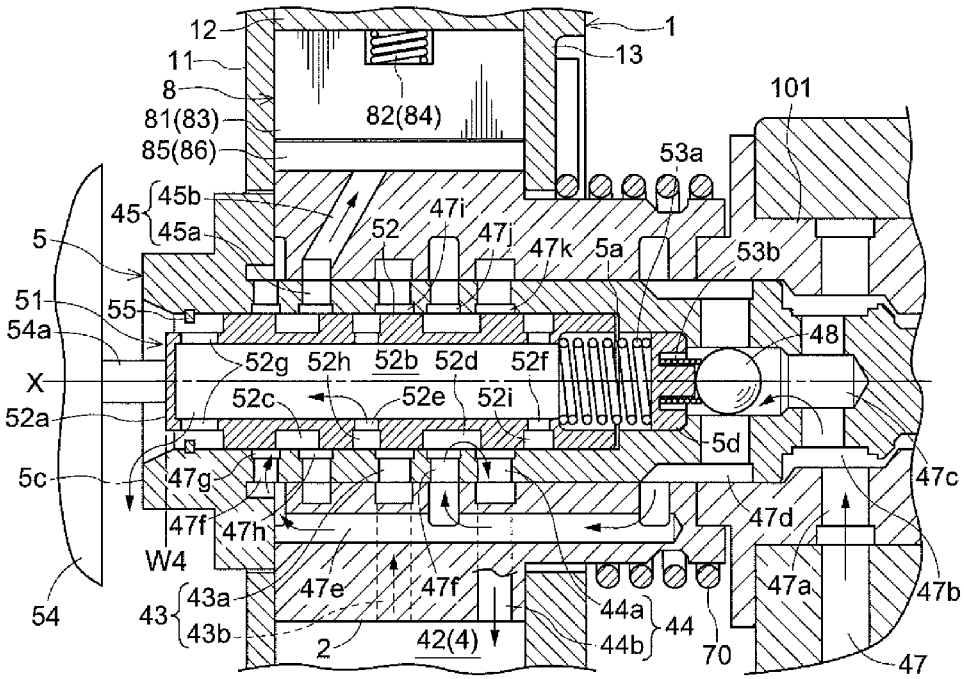
FIG. 8 is an enlarged cross-sectional view showing an active state of the OCV in W4.

As shown in FIG. 8, if electricity is further supplied to the electromagnetic solenoid 54 so that the OCV 51 enters the W4 state shown in FIG. 3, the spool 52 moves slightly rightward from the W3 state. If the working oil is supplied to the supply channel 47 in this state, the working oil will reach the seventh ring-shaped groove 52*c* and the eighth ring-shaped groove 52*d*. Since the seventh ring-shaped groove 52*c* is still connected to the unlocking channels 45, the working oil flows through the unlocking channels 45 and is supplied to the first recessed portion 85 and the second recessed portion 86. In other words, the unlocking channels 45 are in the supply state. Accordingly, in the W4 state as well, the unlocked state is maintained continuously from when in the W2 and W3 states. Note that FIG. 8 shows a state directly after a switch from the W3 state to the W4 state is performed.

In the W4 state, the eighth ring-shaped groove 52*d* is connected to the retarding channels 44 via the fifth ring-shaped groove 47*k*, and therefore the working oil flows through the retarding channels 44 and is supplied to the retarding chambers 42. In other words, the retarding channels 44 are in the supply state. On the other hand, the advancing channels 43 are connected to the first through hole 52*e* via the third ring-shaped groove 47*i* and the ninth ring-shaped groove 52*h*, and therefore the working oil in the advancing chambers 41 flows from the main discharge channel 52*b* and is discharged to the outside of the valve opening/closing timing control device 10 through the third through holes 52*g*. In other words, the advancing channels 43 are in the drain state. Thus, as shown in FIG. 3, the W4 state is a state in which the working oil is supplied to the intermediate lock mechanism 8 (first recessed portion 85, second recessed portion 86) and the retarding chambers 42, the working oil is discharged from the advancing chambers 41, and the relative rotation phase changes in the retard direction S2. This corresponds to "a retarding action in an unlocked state". The W4 state also corresponds to a phase changeable mode in the present invention.

In the W4 state, the flow amount of the working oil that is discharged from the advancing chambers 41 and flows through the advancing channels 43 is determined by the opposing areas of the third ring-shaped groove 47*i* and the ninth ring-shaped groove 52*h* (hereinafter referred to as "seventh area"). The flow amount of the working oil that flows through the retarding channels 44 and is supplied to the retarding chambers 42 is determined by the smaller of the second area and the area of opposition between the eighth ring-shaped groove 52*d* and the fifth ring-shaped groove 47*k* (hereinafter referred to as "eighth area"). In the state shown in FIG. 8, the eighth area is smaller than the second area, and therefore the flow amount of the working oil is determined by the eighth area. The flow amount of the working oil that flows through the unlocking channels 45 and is supplied to the first recessed portion 85 and the second recessed portion 86 is determined by the fifth area since the fifth area is smaller than the sixth area.

If electricity is further supplied to the electromagnetic solenoid 54 while the W4 state shown in FIG. 3 is maintained, the spool 52 moves rightward from the state shown in FIG. 8. Accompanying the movement, the seventh area increases monotonically. Accordingly, as shown in FIG. 4, the flow amount of the working oil that is discharged from the advancing chambers 41 and flows through the advancing channels 43 (the broken line in the upper graph) increases from the W3 state. Although the second area does not change, the eighth area increases monotonically, and the flow amount of the working oil that flows through the retarding channels 44 and is supplied to the retarding chambers 42 (solid line in the upper graph) also increases from the W3 state. That is to say, when the amount of electricity supplied to the electromagnetic solenoid 54 is increased, the speed at which the relative rotation phase changes in the retard direction S2 increases.

Since the fifth area decreases monotonically and the sixth area increases monotonically, the flow amount of the working oil that flows through the unlocking channels 45 and is supplied to the first recessed portion 85 and the second recessed portion 86 (the solid line in the lower graph) decreases. That is to say, when the amount of electricity supplied to the electromagnetic solenoid 54 is the minimum for maintaining the W4 state, the flow amounts of the working oil that flows through the advancing channels 43 and the retarding channels 44 reach their minimums, and the flow amount of the working oil that flows through the unlocking channels 45 reaches its maximum.

Figure 9:
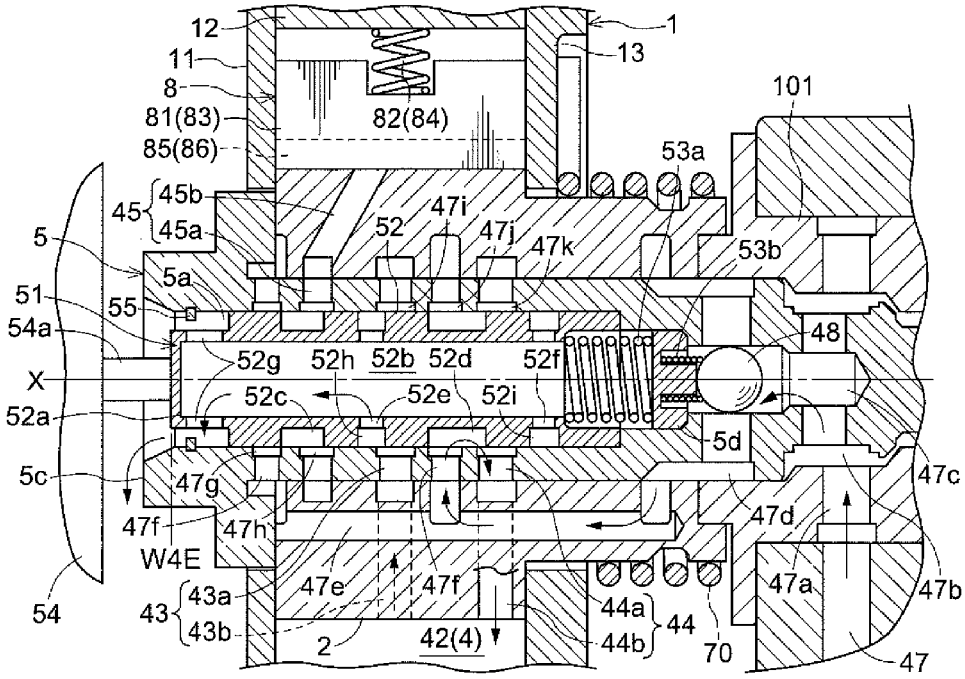
FIG. 9 is an enlarged cross-sectional view showing an active state of the OCV in W4E.
Figure 10:
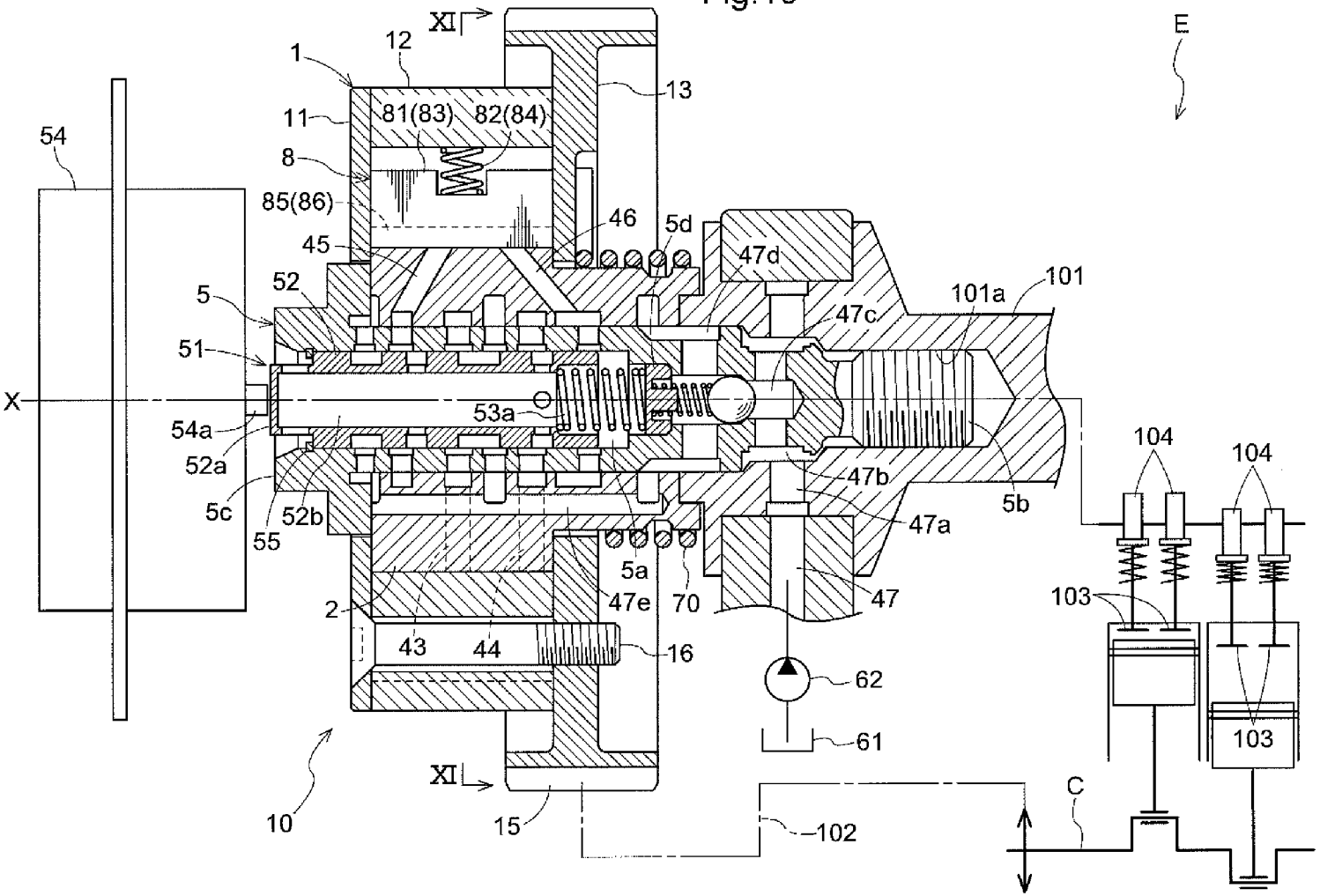
FIG. 10 is a vertical cross-sectional view showing a configuration of a valve opening/closing timing control device according to a second embodiment.

As shown in FIG. 9, if the amount of electricity supplied to the electromagnetic solenoid 54 is increased to its maximum so that the OCV 51 enters the state of being on the right end of W4 shown in FIG. 3, the spool 52 moves slightly rightward from the state shown in FIG. 8, comes into contact with the bottom surface of the accommodation space 5*a*, and stops. This state corresponds to the W4E state shown in FIG. 4. At this time, the seventh area reaches its maximum, and therefore the flow amount of the working oil that is discharged from the advancing chambers 41 and flows through the advancing channels 43 reaches its maximum. Also, since the eighth area is also at its maximum, the flow amount of the working oil that flows through the retarding channels 44 and is supplied to the retarding chambers 42 also reaches its maximum. That is to say, the speed at which the relative rotation phase changes in the retard direction S2 reaches its maximum. On the other hand, since the fifth area reaches 0, the working oil does not flow through the unlocking channels 45 and the working oil is not supplied to the first recessed portion 85 and the second recessed portion 86. At this time, although the sixth area is at its maximum, the unlocking channels 45 are only connected to the seventh ring-shaped groove 52*c*, and therefore the working oil in the first recessed portion 85 and the second recessed portion 86 does not flow through the unlocking channels 45 and is not discharged.

In the lock transition mode of the valve opening/closing timing control device 10 according to the present embodiment with the above-described configuration, there is a positive correlative relationship between the flow amount of the working oil that flows through the advancing channels 43, the flow amount of the working oil that flows through the retarding channels 44, and the flow amount of the working oil that flows through the unlocking channels 45. Specifically, when the amount of electricity supplied to the electromagnetic solenoid 54 approaches 0, the flow amount of the working oil that flows through the advancing channels 43, the flow amount of the working oil that flows through the retarding channels 44, and the flow amount of the working oil that flows through the unlocking channels 45 all increase. If the flow amount of the working oil that flows through the advancing channels 43 increases, the supply of working oil to the advancing chambers 41 is performed more rapidly, and if the flow amount of working oil that flows through the retarding channels 44 is increased, the discharge of working oil from the retarding chambers 42 is performed more rapidly. If the supply of working oil to the advancing chambers 41 and the retarding chambers 42 is performed more rapidly, the speed at which the relative rotation phase changes in the advance direction S1 increases. Also, if the flow amount of the working oil that flows through the unlocking channels 45 increases, the discharge of working oil in the first recessed portion 85 and the second recessed portion 86 is performed more rapidly.

Accordingly, when the amount of electricity supplied to the electromagnetic solenoid 54 is 0, the flow amount of the working oil that flows through the advancing channels 43, the flow amount of the working oil that flows through the retarding channels 44, and the flow amount of the working oil that flows through the unlocking channels 45 all reach their maximums. Therefore, the speed at which the relative rotation phase changes in the advance direction S1 can be maximally increased, and the working oil in the first recessed portion 85 and the second recessed portion 86 can be discharged at the maximum speed. Accordingly, by setting the amount of electricity supplied to the electromagnetic solenoid 54 to 0 when the relative rotation phase is in the vicinity of the maximum retard phase, the relative rotation phase can be changed in the advance direction S1 at a high speed and the state of being locked in the intermediate lock phase P can be realized in a short amount of time.

Also, in the phase changeable mode of the valve opening/closing timing control device 10 according to the present embodiment, when in a state where the relative rotation phase is held (W3 state), the area that determines the passage of the working oil to the intermediate lock mechanism 8 reaches its maximum. Pressure loss accompanying passage of the working oil decreases as the area increases, and therefore if the area is at its maximum, the pressure loss in the working oil that is supplied to the intermediate lock mechanism 8 is at its minimum. As a result, the lower limit value of the oil pressure pulsation of the working oil can be raised, and the occurrence of an unintended locked state can be suppressed.

Also, the valve opening/closing timing control device 10 according to the present embodiment is configured such that regardless of the direction in which the spool 52 moves from the position of the spool 52 at which the area is at its maximum, the flow amount of the working oil that is supplied to the intermediate lock mechanism 8 decreases monotonically and becomes 0 when switching between W2 and W1 is performed. Accordingly, it is possible to switch from the phase changeable mode to the lock transition mode quickly and reliably.

2. Second Embodiment

Hereinafter, the valve opening/closing timing control device 10 according to a second embodiment of the present invention will be described in detail with reference to the drawings. In the description of the present embodiment, portions of the configuration that are the same as in the first embodiment are denoted by the same reference numerals, and description relating to similar configurations will not be repeated here. In the valve opening/closing timing control device 10 of the present embodiment, lock discharge channels 46 are formed in addition to the unlocking channels 45 as channels through which the working oil that is supplied to and discharged from the intermediate lock mechanism 8 flows.

Similarly to the unlocking channels 45, the lock discharge channels 46 are also connected to the bottom surfaces of the deep groove of the first recessed portion 85 and the deep groove of the second recessed portion 86. However, the unlocking channels 45 allow the passage of working oil that is supplied to and discharged from the first recessed portion 85 and the second recessed portion 86, whereas the lock discharge channels 46 do not allow passage of the working oil supplied to the first recessed portion 85 and the second recessed portion 86 and allow only passage of the working oil that is discharged from the first recessed portion 85 and the second recessed portion 86 to the outside of the valve opening/closing timing control device 10.

As shown in FIGS. 10, 11, and FIGS. 14 to 19, the lock discharge channels 46 that connect to the first recessed portion 85 and the second recessed portion 86 are each constituted by a first discharge portion 46*a* formed in a fixing bolt 5, and a second discharge portion 46*b* that is connected to the first discharge portion 46*a* and is formed in the inner rotor 2. The first discharge portion 46*a* is connected to a sixth ring-shaped groove 47*m* formed in the inner circumferential surface opposing the accommodation space 5*a* of the fixing bolt 5.

Operation of OCV (1) W1 State

Figures 11, 12:
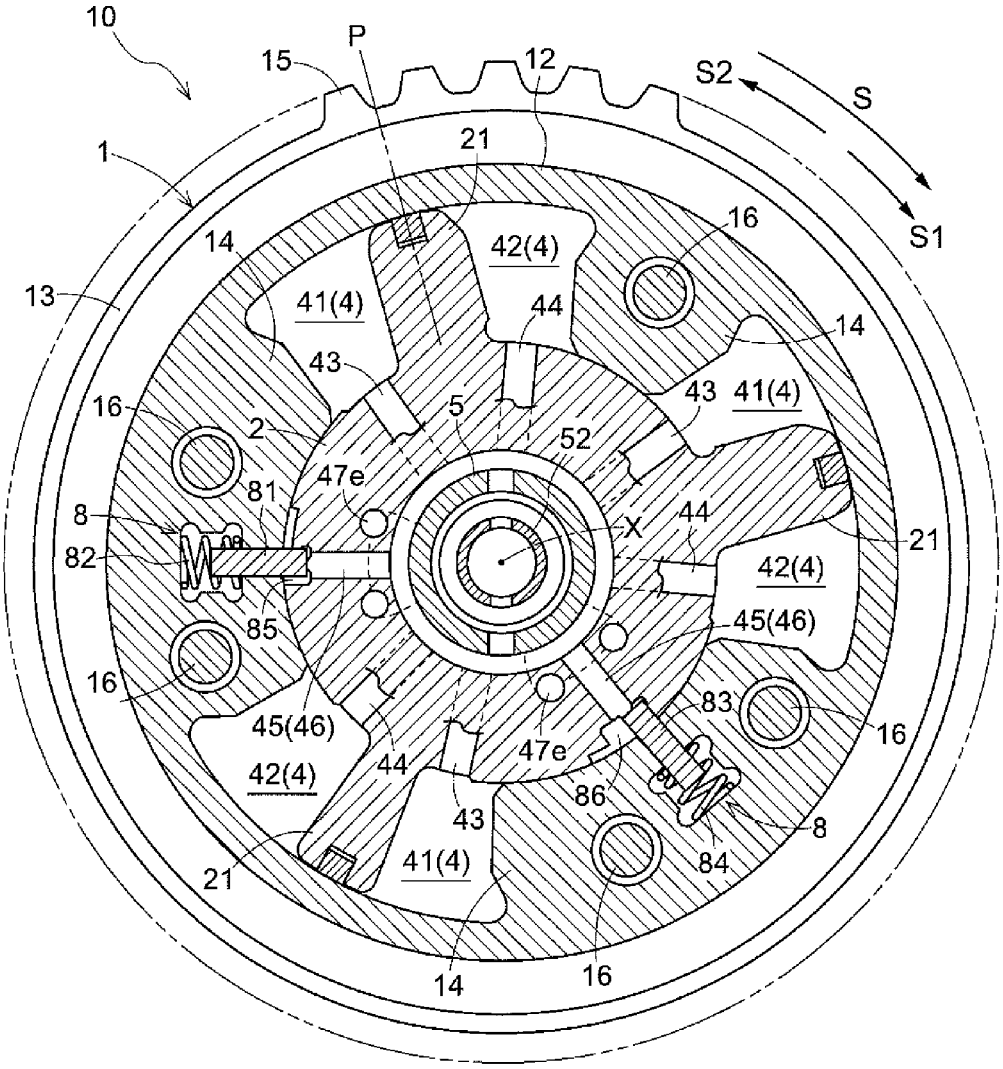
FIG. 11 is a cross-sectional view taken along line XI-XI in FIG. 10.
FIG. 12 is a diagram showing a state in which working oil flows through channels due to the action of the OCV.
Figure 14:
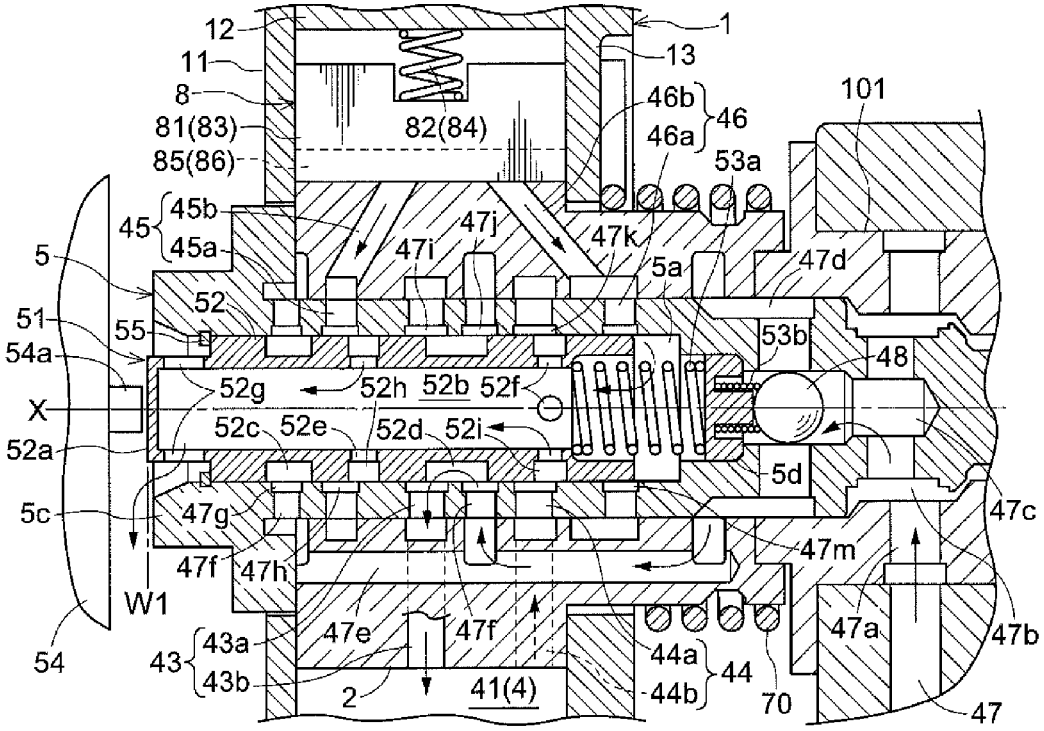
FIG. 14 is an expanded cross-sectional view showing an active state of the OCV in W1.
Figure 15:
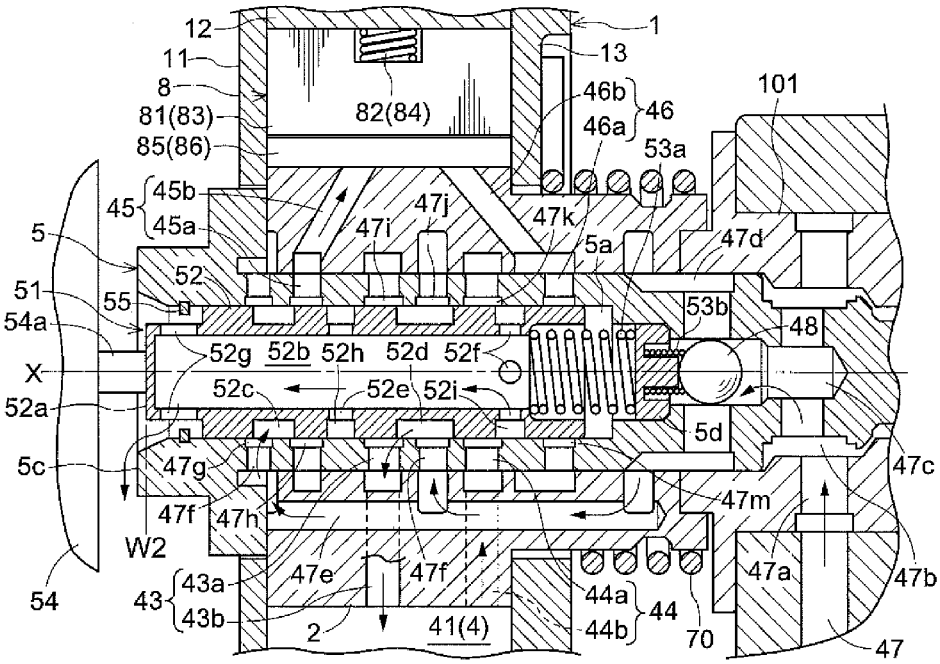
FIG. 15 is an expanded cross-sectional view showing an active state of the OCV in W2.
Figure 16:
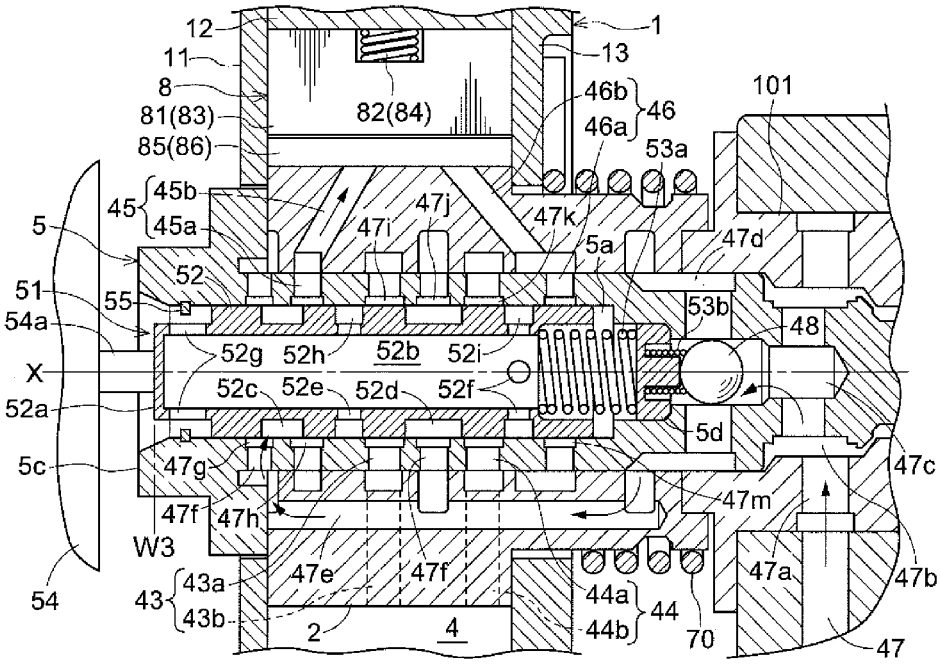
FIG. 16 is an expanded cross-sectional view showing an active state of the OCV in W3.
Figure 17:
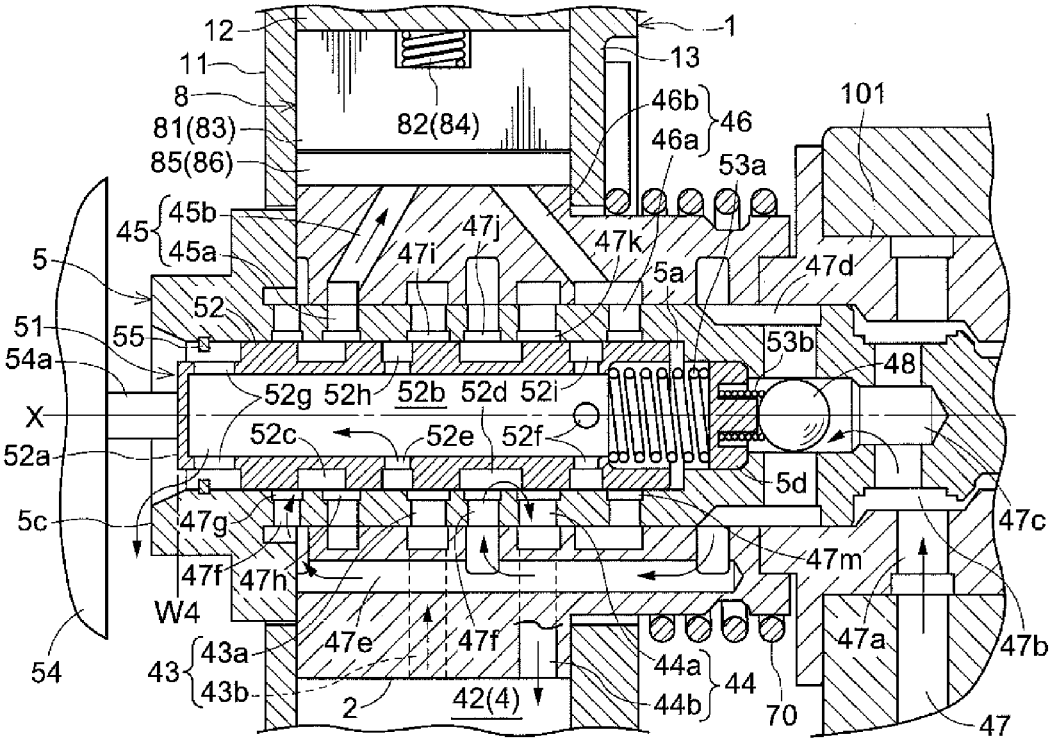
FIG. 17 is an expanded cross-sectional view showing an active state of the OCV in W4.

As shown in FIG. 14, if no electricity is supplied to the electromagnetic solenoid 54 (the electricity supply amount is 0), the OCV 51 is in the W1 state shown in FIG. 12, and due to the biasing force of the first valve spring 53*a*, the spool 52 comes into contact with the stopper 55 and is located leftmost. When working oil is supplied to the supply channel 47 in this state, similarly to the first embodiment, the working oil that flows through the advancing channels 43 is supplied to the advancing chambers 41, and at the same time, the working oil is discharged from the retarding chambers 42 and flows through the retarding channels 44 and the working oil discharged from the intermediate lock mechanism 8 also flows through the unlocking channels 45. At this time, the working oil that flows through the lock discharge channels 46 is discharged to the accommodation space 5*a* via the sixth ring-shaped groove 47*m*, and thereafter is discharged from the main discharge channel 52*b* to the outside of the valve opening/closing timing control device 10 through the third through holes 52*g*. That is to say, the working oil in the intermediate lock mechanism 8 (first recessed portion 85, second recessed portion 86) is discharged from both the unlocking channels 45 and the lock discharge channels 46. Hereinafter, the unlocking channels 45, the second ring-shaped groove 47*h*, the ninth ring-shaped groove 52*h*, the first through hole 52*e*, the lock discharge channels 46, and the sixth ring-shaped groove 47*m* in the W1 state of the present embodiment will be collectively referred to as a first discharge channel.

As shown in FIG. 12, the W1 state is a state in which working oil is discharged from intermediate lock mechanism 8 (first recessed portion 85 and second recessed portion 86) and the retarding chambers 42, the working oil is supplied to the advancing chambers 41, and thereby the relative rotation phase changes in the advance direction S1. This corresponds to "locking in an intermediate lock phase P by means of an advancing action". The W1 state corresponds to a lock transition mode in the present invention.

In the W1 state, the flow amount of the working oil that is discharged from the first recessed portion 85 and the second recessed portion 86 and flows through the unlocking channels 45 is determined by a fourth area, which is the same as that in the first embodiment, and the flow amount of the working oil that is discharged from the first recessed portion 85 and the second recessed portion 86 and flows through the lock discharge channels 46 is determined by the area of opposition between the sixth ring-shaped groove 47*m* and the accommodation space 5*a* (hereinafter referred to as "ninth area"). Accordingly, the flow amount of the working oil that flows through the first discharge channel so as to be discharged is determined by the sum of the fourth area and the ninth area.

Figure 13:
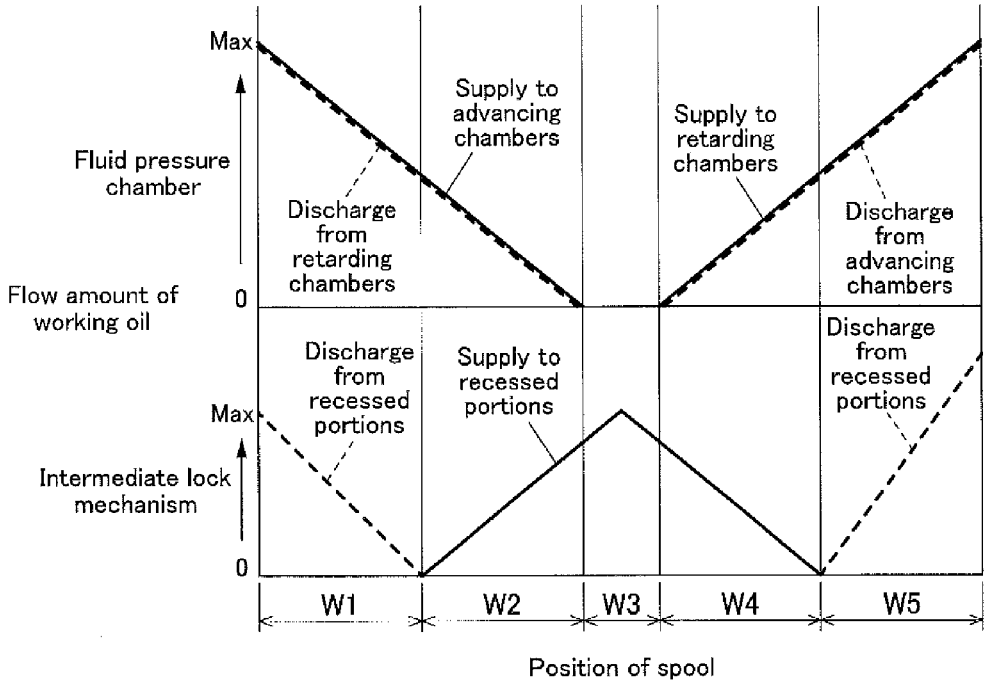
FIG. 13 is a graph showing change in the flow amounts of working oil supplied to and discharged from the advancing chamber, retarding chamber, and intermediate lock mechanism when the position of the spool is changed.

As shown in FIG. 13, when in the W1 state, the relationship between the amount of electricity supplied to the electromagnetic solenoid 54 and the flow amount of the working oil that flows through the advancing channels 43, the retarding channels 44, and the first discharge channel is the same as in the first embodiment. That is to say, when the amount of electricity supplied to the electromagnetic solenoid 54 is 0, all of the flow amounts reach their maximum, the speed at which the relative rotation phase changes in the advance direction S1 reaches its maximum, and the working oil in the first recessed portion 85 and the second recessed portion 86 is discharged at the maximum speed. Also, as the electricity supply amount increases, the flow amount decreases, and the speed at which the relative rotation phase changes in the advance direction S1 also decreases.

(2) W2, W3, and W4 States

As shown in FIGS. 12, 15, 16, and 17, when the OCV 51 is in the W2, W3, and W4 states, the lock discharge channels 46 are not connected to the supply channel 47 or the main discharge channel 52*b*, and therefore no working oil flows through the lock discharge channels 46. That is to say, the increasing/decreasing tendencies of the working oil that flows through the advancing channels 43, the retarding channels 44, and the unlocking channels 45 in the W2, W3, and W4 states are the same as in the first embodiment, as shown in FIGS. 12 and 13. That is to say, the W2 state corresponds to "an advancing action in an unlocked state", the W3 state corresponds to "intermediate phase holding", and the W4 state corresponds to "a retarding action in an unlocked state", and all of these states correspond to the phase changeable mode. For this reason, in the present embodiment, detailed description thereof is not included.

(3) W5 State

Figure 18:
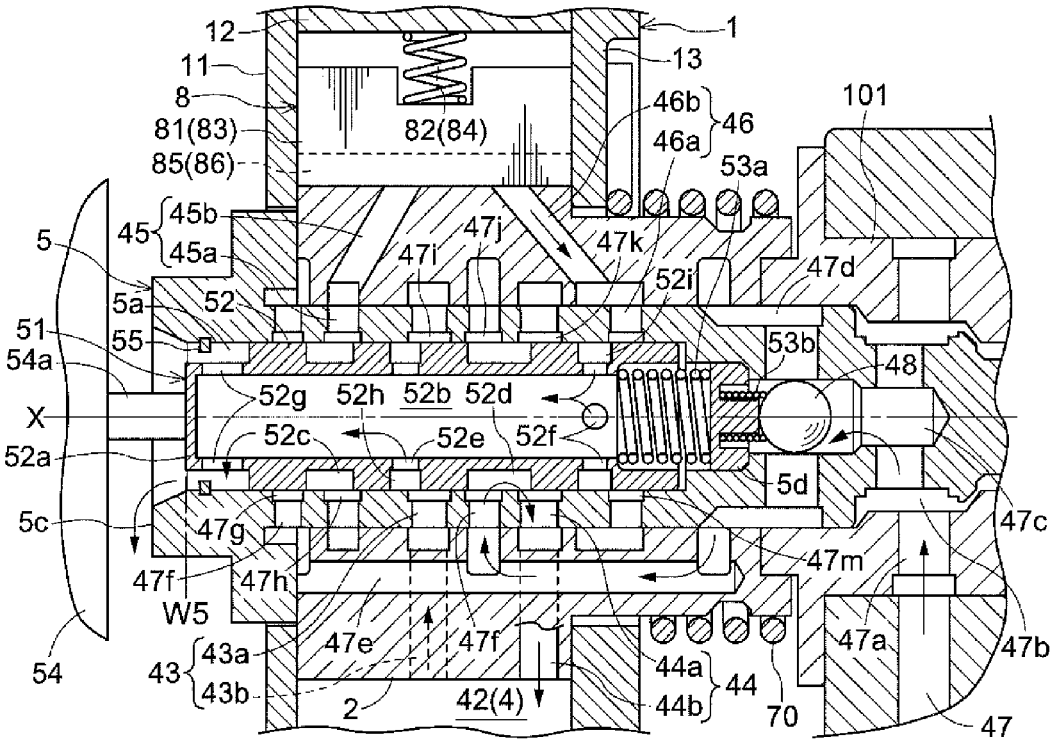
FIG. 18 is an expanded cross-sectional view showing an active state of the OCV in W5.

In the present embodiment, even if the state shown in FIG. 9 in the first embodiment (W4E state) is entered, there is a gap between the spool 52 of the OCV 51 and the bottom surface of the accommodation space 5*a*, and by increasing the amount of electricity supplied to the electromagnetic solenoid 54, the spool 52 moves further rightward, entering the W5 state shown in FIG. 18. When the working oil is supplied to the supply channel 47 in this state, the working oil discharged from the advancing chambers 41 flows through the advancing channels 43 continuously from when in the W4 state, and the working oil that flows through the retarding channels 44 is supplied to the retarding chambers 42. Although the working oil that flows through the unlocking channels 45 is connected to the seventh ring-shaped groove 52*c*, the seventh ring-shaped groove 52*c* and the first ring-shaped groove 47*g* do not oppose each other, and the fifth area is 0. In other words, no working oil flows through the unlocking channels 45.

When in the W5 state, the working oil in the intermediate lock mechanism 8 flows through only the lock discharge channels 46, is discharged from the second through hole 52*f* to the main discharge channel 52*b* via the sixth ring-shaped groove 47*m* and the tenth ring-shaped groove 52*i*, and is discharged to the outside of the valve opening/closing timing control device 10 through the third through holes 52*g*. Hereinafter, the lock discharge channels 46, the sixth ring-shaped groove 47*m*, the tenth ring-shaped groove 52*i*, and the second through hole 52*f* in the W5 state of the present embodiment will be referred to collectively as a second discharge channel.

As shown in FIG. 12, the W5 state is a state in which the working oil is discharged from the intermediate lock mechanism 8 (first recessed portion 85 and second recessed portion 86) and the advancing chambers 41, the working oil is supplied to the retarding chambers 42, and thereby the relative rotation phase changes in the retard direction S2. This corresponds to "locking in an intermediate lock phase P by means of a retarding action". The W5 state also corresponds to a lock transition mode of the present invention, similarly to the W1 state.

In the W5 state, the flow amount of the working oil that is discharged from the advancing chambers 41 and flows through the advancing channels 43 is determined by the seventh area, and the flow amount of the working oil that flows through the retarding channels 44 and is supplied to the retarding chambers 42 is determined by the eighth area. This is the same as the W4 state, but both the seventh area and the eighth area are even larger than the maximum area in the W4 state. On the other hand, the flow amount of the working oil that flows through the second discharge channel so as to be discharged is determined by the area of opposition between the sixth ring-shaped groove 47*m* and the tenth ring-shaped groove 52*i* (hereinafter referred to as "tenth area").

Figure 19:
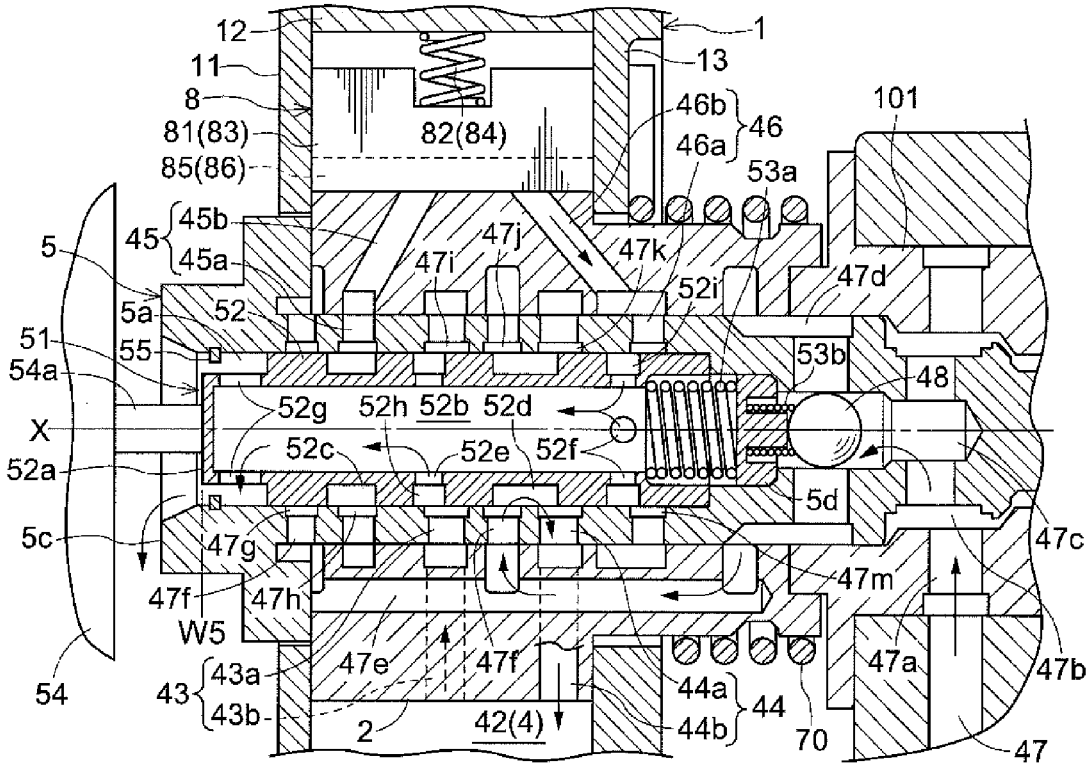
FIG. 19 is an expanded cross-sectional view showing an active state of the OCV in W5.

If electricity is further supplied to the electromagnetic solenoid 54 while the W5 state shown in FIG. 18 is maintained, the spool 52 moves rightward from the state shown in FIG. 18, and as shown in FIG. 19, the spool 52 comes into contact with the bottom surface of the accommodation space 5*a* and stops. As shown in FIGS. 18 and 19, the seventh area increases monotonically as the spool 52 moves rightward. Accordingly, as shown in FIG. 13, the flow amount of the working oil that is discharged from the advancing chambers 41 and flows through the advancing channels 43 (broken line in the upper graph) continues to increase as in the W4 state. In the retarding channels 44, the second area decreases slightly, but since the eighth area, which is even smaller, increases monotonically, the eighth area is the determinant. For this reason, the flow amount of the working oil that flows through the retarding channels 44 and is supplied to the retarding chambers 42 (solid line in the upper graph) also continues to increase as in the W4 state. That is to say, when the amount of electricity supplied to the electromagnetic solenoid 54 is increased, the speed at which the relative rotation phase changes in the retard direction S2 increases further.

Since the tenth area increases monotonically, the flow amount of the working oil that is discharged from the first recessed portion 85 and the second recessed portion 86 and flows through the second discharge channel (broken line in the lower graph) increases. That is to say, when the amount of electricity supplied to the electromagnetic solenoid 54 is the minimum for maintaining the W5 state, the flow amounts of the working oil that flows through the advancing channels 43, the retarding channels 44, and the second discharge channel reach their minimum, and as the electricity supply amount increases, the flow amounts also increase.

As a result, as shown in FIG. 13, from the W4 state to the W5 state, the flow amount of the working oil that is discharged from the advancing chambers 41 and flows through the advancing channels 43 and the flow amount of the working oil that flows through the retarding channels 44 and is supplied to the retarding chambers 42 both increase monotonically, and the relative rotation phase changes in the retard direction S2. Also, the maximum flow amounts of the working oil that is discharged from the advancing chambers 41 and flows through the advancing channels 43 and the working oil that flows through the retarding channels 44 and is supplied to the retarding chambers 42 when in the lock transition mode (W5) are larger than the maximum flow amounts of the working oil that is discharged from the advancing chambers 41 and flows through the advancing channels 43 and the working oil that flows through the retarding channels 44 and is supplied to the retarding chambers 42 when in the phase changeable mode (W4). On the other hand, the working oil that flows through the lock discharge channels 46 and is supplied to or discharged from the intermediate lock mechanism 8 is discharged as the flow amount decreases monotonically in the W4 state, and temporarily reaches 0 when switching from W4 to W5 is performed. Thereafter, upon switching to W5, switching from supplying to discharging is performed, and while in the W5 state, the flow amount of the working oil discharged from the intermediate lock mechanism 8 increases monotonically.

As shown in FIG. 13, the absolute value of the slope of the change in the flow amount of the working oil that flows through the second discharge channel when the electricity supply amount of the electromagnetic solenoid 54 in the W5 state is changed is greater than the absolute value of the slope of the change in the flow amount of the working oil that flows through the first discharge channel when the electricity supply amount of the electromagnetic solenoid 54 in the W1 state is changed. This is because the tenth area in the W5 state is configured to be greater than the sum of the fourth area and the ninth area in the W1 state.

In the present embodiment, similarly to the first embodiment, an average displacement force caused by variations in the torque of the camshaft 101 that are generated by the rotation of the cams 104 acts on the inner rotor 2, and the direction in which it acts is the retard direction S2. Also, the biasing force in the advance direction S1 of the return spring 70 acts from the maximum retard phase to the intermediate lock phase P, but it is canceled out by the average displacement force in the retard direction S2. As a result, the speed with which the relative rotation phase is changed toward the retard side when in the vicinity of the maximum advance phase (retard change speed) is greater than the speed with which the relative rotation phase is changed toward the advance side when in the vicinity of the maximum retard phase (advance change speed). For this reason, in order to rotate the inner rotor 2 in the retard direction S2 so as to reliably constrain the relative rotation phase to the intermediate lock phase P, the speed at which the working oil is discharged from the first recessed portion 85 and the second recessed portion 86 needs to be made greater than when the inner rotor 2 is rotated in the advance direction S1 so as to constrain the relative rotation phase to the intermediate lock phase P.

In the present embodiment, the ratio of the tenth area to the sum of the fourth area and the ninth area, or in other words, the ratio of the flow amount of the working oil that flows through the second discharge channel to the flow amount of the working oil that flows through the first discharge channel is increased to be greater than or equal to the ratio of the retard change speed to the advance change speed. With this configuration, the speed at which the working oil is discharged from the first recessed portion 85 and the second recessed portion 86 can be increased, and even when the inner rotor 2 is rotated in the retard direction S2, the relative rotation phase can be reliably constrained to the intermediate lock phase P.

3. Other Embodiments

Figure 20:
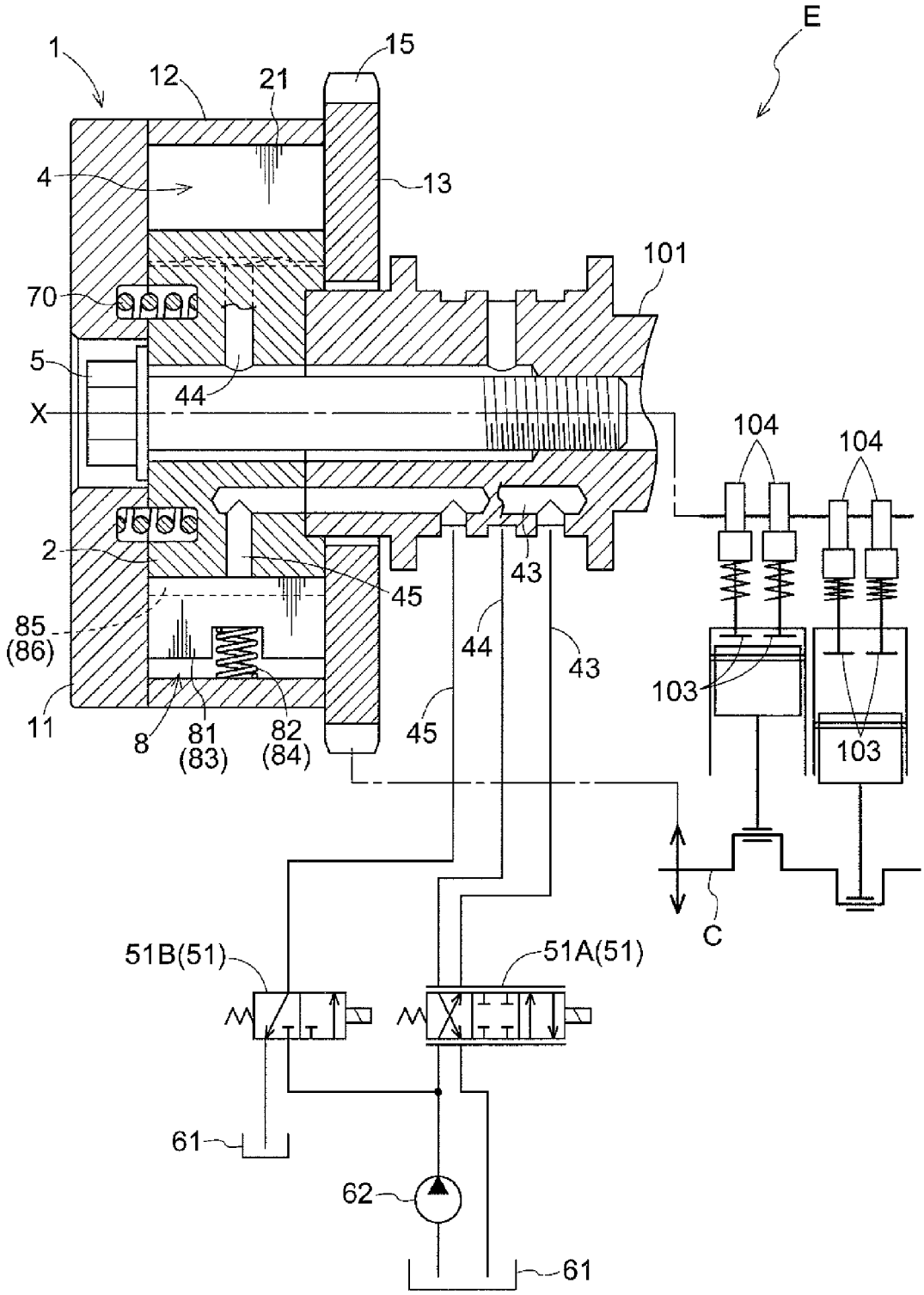
FIG. 20 is a vertical cross-sectional view showing a configuration of a valve opening/closing timing control device according to another embodiment.

In the first embodiment and the second embodiment, the supply and discharge of the working oil to/from the advancing chambers 41, the retarding chambers 42, and the intermediate lock mechanism 8 is controlled by one OCV 51 arranged inside of the inner rotor 2, but there is no limitation to this. For example, a configuration may be used in which the functions of the OCV 51 are divided into two, an OCV 51A that controls only the supply and discharge of the working oil to/from the advancing chambers 41 and the retarding chambers 42 is arranged on the inside of the inner rotor 2, and an OCV 51B that controls the supply and discharge of working oil to/from the intermediate lock mechanism 8 is arranged on the outside of the housing 1. Also, as shown in FIG. 20, a configuration may be used in which both the OCV 51A and the OCV 51B are arranged on the outside of the housing 1. In such a case, it is preferable to use a three-position proportional control valve in which the flow amount of the working oil changes due to the position of the spool 52 as the OCV 51A.

With this kind of configuration as well, it is possible to obtain effects similar to those obtained in the first embodiment and the second embodiment.

INDUSTRIAL APPLICABILITY

The present invention can be used in a valve opening/closing timing control device that controls a relative rotation phase of a driven rotating body with respect to a driving rotating body that rotates synchronously with a crankshaft of an internal combustion engine.

DESCRIPTION OF REFERENCE SIGNS

1 Housing (driving rotating body)
2 Inner rotor (driven rotating body)
4 Fluid pressure chamber
8 Intermediate lock mechanism
10 Valve opening/closing timing control device
21 Protruding portion (partition)
41 Advancing chamber
42 Retarding chamber
43 Advancing channel
44 Retarding channel
51 OCV (electromagnetic valve)
52 Spool
101 Camshaft
C Crankshaft (driving shaft)
E Engine (internal combustion engine)
P Intermediate lock phase
S1 Advance direction
S2 Retard direction
X Axis

The invention claimed is:

1. A valve opening/closing timing control device, comprising:

a driving rotating body that rotates synchronously with a driving shaft of an internal combustion engine;

a driven rotating body that is arranged inside of the driving rotating body coaxially with an axis of the driving rotating body, and rotates integrally with a camshaft for opening/closing a valve of the internal combustion engine;

a fluid pressure chamber defined between the driving rotating body and the driven rotating body;

an advancing chamber and a retarding chamber formed by partitioning the fluid pressure chamber using a partition provided on at least one of the driving rotating body and the driven rotating body;

an intermediate lock mechanism capable of, with supply/discharge of a working fluid, selectively switching between a locked state in which a relative rotation phase of the driven rotating body with respect to the driving rotating body is constrained to an intermediate lock phase between a maximum advance phase and a maximum retard phase, and an unlocked state in which the constraint to the intermediate lock phase is released;

an advancing channel that allows passage of the working fluid to be supplied to or discharged from the advancing chamber;

a retarding channel that allows passage of the working fluid to be supplied to or discharged from the retarding chamber; and at least one electromagnetic valve that changes a position of a spool by changing an electricity supply amount, and controls the supply and discharge of the working fluid to/from the advancing chamber, the retarding chamber, and the intermediate lock mechanism, wherein when in a lock transition mode in which the electromagnetic valve is controlled such that the working fluid is discharged from the intermediate lock mechanism, the working fluid is supplied to one of the advancing chamber and the retarding chamber, and the working fluid is discharged from the other one, maximum flow amounts of the working fluid that flows through the advancing channel and the retarding channel are greater than maximum flow amounts of the working fluid that flows though the advancing channel and the retarding channel when in a phase changeable mode in which the electromagnetic valve is controlled such that the working fluid is supplied to the intermediate lock mechanism, in the lock transition mode, the relative rotation phase is configured to be changeable in both an advance direction and a retard direction, in the lock transition mode, the working fluid flows through a first discharge channel so as to be discharged from the intermediate lock mechanism while the relative rotation phase changes in the advance direction when the spool of the electromagnetic valve is at one end of the range of motion of the spool, and the working fluid flows through a second discharge channel so as to be discharged from the intermediate lock mechanism while the relative rotation phase changes in the retard direction when the spool is at the other end of the range of motion, if a retard change speed, which is a speed of the driven rotating body when the relative rotation phase changes in the retard direction, is greater than an advance change speed, which is a speed of the driven rotating body when the relative rotation phase changes in the advance direction, a flow amount of the working fluid that flows through the second discharge channel is greater than a flow amount of the working fluid that flows through the first discharge channel by at least a ratio of the retard change speed to the advance change speed, and if the advance change speed is greater than the retard change speed, the flow amount of the working fluid that flows through the first discharge channel is greater than the flow amount of the working fluid that flows through the second discharge channel by at least a ratio of the advance change speed to the retard change speed.

2. The valve opening/closing timing control device according to claim 1, wherein when in the lock transition mode, a flow amount of the working fluid that flows through the advancing channel and the retarding channel increases as the spool of the electromagnetic valve approaches an end of a range of motion of the spool.

3. The valve opening/closing timing control device according to claim 1, wherein in the phase changeable mode, the flow amount of the working fluid when the working fluid is supplied to the intermediate lock mechanism while the relative rotation phase is held is greater than the flow amount of the working fluid when the working fluid is supplied to the intermediate lock mechanism while the relative rotation phase is changed.

* * * * *